US010879641B2

(12) United States Patent
Takeuchi et al.

(10) Patent No.: US 10,879,641 B2
(45) Date of Patent: Dec. 29, 2020

(54) TERMINAL, CHAIN TERMINAL, AND CONNECTOR

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP); TOYOTA JIDOSHA KABUSHIKI KAISHA, Toyota (JP)

(72) Inventors: Shunya Takeuchi, Yokkaichi (JP); Masaaki Tabata, Yokkaichi (JP); Yasuo Omori, Yokkaichi (JP); Hiroshi Kobayashi, Okazaki (JP); Takeshi Misaiji, Seto (JP)

(73) Assignees: AutoNetworks Technologies, Ltd.; Sumitomo Wiring Systems, Ltd.; Sumitomo Electric Industries, Ltd.; Toyota Jidosha Kabushiki Kaisha

( * ) Notice: Subject to any disclaimer, the term of this patent is extended or adjusted under 35 U.S.C. 154(b) by 0 days.

(21) Appl. No.: 16/545,119

(22) Filed: Aug. 20, 2019

(65) Prior Publication Data

US 2020/0076109 A1 Mar. 5, 2020

(30) Foreign Application Priority Data

Aug. 29, 2018 (JP) ..... 2018-160736

(51) Int. Cl.
*H01R 9/24* (2006.01)
*H01R 13/41* (2006.01)
(Continued)

(52) U.S. Cl.
CPC ..... *H01R 13/41* (2013.01); *H01R 13/113* (2013.01); *H01R 43/16* (2013.01)

(58) Field of Classification Search
CPC ..... H01R 13/111; H01R 13/11; H01R 13/04; H01R 43/16; H01R 4/185; H01R 4/70; H01R 4/20; H02G 15/013; H02G 15/18
(Continued)

(56) References Cited

U.S. PATENT DOCUMENTS 4,354,310 A * 10/1982 Hatton ..... H01F 41/04 29/605
4,717,354 A * 1/1988 McCleerey ..... H01R 4/20 439/444
(Continued)

FOREIGN PATENT DOCUMENTS

CN 105281080 1/2016
JP 59-14282 1/1984
(Continued)

*Primary Examiner* — Thanh Tam T Le
(74) *Attorney, Agent, or Firm* — Gerald E. Hespos; Michael J. Porco; Matthew T. Hespos

(57) ABSTRACT

A terminal disclosed herein is a female terminal that is contained in a housing and includes: a connection tubular part provided to be connectable to a counterpart terminal and including a bottom plate; a carrier cut part provided at an edge of the bottom plate; and a projection projecting from the carrier cut part. The carrier cut part is provided at an upper edge part opposite to a lower side corresponding to the housing side along the plate thickness of the bottom plate. The bottom plate includes a bottom surface on the housing side and an upper surface opposite to the bottom surface. The projection is provided to the upper surface side of the bottom plate compared to the bottom surface thereof.

8 Claims, 32 Drawing Sheets

(51) Int. Cl.
*H01R 43/16* (2006.01)
*H01R 13/11* (2006.01)

(58) Field of Classification Search
USPC ..... 439/851, 855, 884, 885, 877; 174/74 R, 174/84 R, 84 C, 88 R
See application file for complete search history.

(56) References Cited

U.S. PATENT DOCUMENTS 5,000,704 A * 3/1991 Costa ..... H01F 5/04 29/882
6,264,511 B1 * 7/2001 Bu ..... H01R 43/16 439/885
6,406,338 B1 * 6/2002 Endo ..... H01R 13/055 29/874
6,700,066 B1 * 3/2004 Kuo ..... H01R 9/0512 174/74 R
6,979,235 B2 * 12/2005 Lappohn ..... H01R 13/111 439/733.1
7,059,921 B2 * 6/2006 Mulot ..... H01R 13/11 439/852
7,223,134 B2 * 5/2007 Chaillot ..... H01R 13/11 439/851
7,621,788 B1 * 11/2009 Feng ..... H01R 43/16 439/885
7,635,282 B2 * 12/2009 Sakamoto ..... H01R 4/184 439/578
7,988,500 B2 * 8/2011 Furukawa ..... H01R 13/41 439/66
8,061,027 B2 * 11/2011 Garner, Jr. ..... H01R 43/055 29/566.2
8,109,798 B2 * 2/2012 Sun ..... H01R 13/40 439/660
8,113,872 B2 * 2/2012 Takahashi ..... H01R 12/79 439/495
8,167,666 B2 * 5/2012 Koga ..... H01R 4/185 439/595
8,251,759 B2 * 8/2012 Matsunaga ..... H01R 4/185 439/877
8,360,812 B2 * 1/2013 Osvatic ..... H01R 13/055 439/819
8,371,871 B1 * 2/2013 Murphy ..... H01R 12/585 439/444
9,011,189 B2 * 4/2015 Tsukamoto ..... H01R 43/16 439/885
9,325,093 B2 4/2016 Endo et al.
9,373,910 B2 6/2016 Sato
9,509,070 B2 11/2016 Endo et al.
9,780,496 B2 * 10/2017 Guo ..... H01R 13/405
2014/0206245 A1 7/2014 Sato
2015/0380852 A1 12/2015 Endo et al.
2015/0380873 A1 12/2015 Endo et al.

FOREIGN PATENT DOCUMENTS

JP 8-162248 6/1996
JP 2004-531045 10/2004
JP 2012-124112 6/2012
JP 2013-045575 3/2013
JP 2017-143028 8/2017

* cited by examiner

TERMINAL, CHAIN TERMINAL, AND CONNECTOR

BACKGROUND

Field of the Invention

The technology disclosed herein relates to a terminal, a chain terminal, and a connector.

Related Art

One example of a both-side chain terminal having a carrier coupled to each of a rear end of a bottom plate of a compression piece of the terminal and a front end of a bottom plate of an electric contact part is disclosed in Japanese Unexamined Patent Application Publication No. H08-162248. In this both-side chain terminal, the terminal is separated as each carrier is cut off at the same time by a rotary blade.

Incidentally, when a terminal is separated from this type of chain terminal, the terminal may be disposed on a base such that a carrier projects from the base and a border between the carrier and the terminal may be cut from above with a cutting blade. In such a case, when the carrier is cut, a projection such as burr is formed at a bottom plate of an electric contact part in a manner of projecting downward from a carrier cut part formed at a front edge.

When the projection is formed to protrude from the bottom surface of the bottom plate of the electric contact part, inserting the terminal into the housing causes the projection to shave the housing and thus, the housing is damaged. In addition, as the projection shaves the housing, the resistance in inserting the terminal is increased.

SUMMARY

The present description discloses the technology for, when a terminal is contained in a housing, suppressing the increase in inserting resistance and preventing the damage of the housing.

One aspect of the technology disclosed herein is a terminal that is contained in a housing. The terminal includes: a terminal connection part provided to be connectable to a counterpart terminal and including a bottom plate; a carrier cut part provided at an edge of the bottom plate; and a projection projecting from the carrier cut part. The carrier cut part is provided at the edge part of the bottom plate on a side opposite to the housing along a plate thickness of the bottom plate. The bottom plate includes a bottom surface on a side of the housing and an upper surface opposite to the bottom surface. The projection is provided to the bottom plate on a side of the upper surface of the bottom plate compared to the bottom surface.

Another aspect of the technology disclosed herein is a connector including the terminal described above and a housing containing the terminal.

Usually, when the bottom plate of the terminal and the carrier are separated by cutting, a projection is formed by the cutting at a carrier cut part. However, in the above structure, the carrier cut part is provided at an end part of the bottom plate that is on the side opposite to the housing along the plate thickness, and the projection is provided on the upper surface side compared to the bottom surface. Therefore, when the terminal is contained in the housing, the shaving of the inner surface of the housing by the projection can be suppressed. Moreover, the increase of the resistance in inserting the terminal can be suppressed.

The terminal disclosed herein may have the following structure.

The terminal connection part may include the bottom plate, a ceiling plate that faces the bottom plate, and a pair of side plates coupling between both side edges of the bottom plate and both side edges of the ceiling plate, the terminal connection part thereby having a tubular shape into which the counterpart terminal can be inserted. The side plate may include a concave part with a recessed shape at an end part on a side of the bottom plate at an edge of the side plate on a side where the counterpart terminal is inserted. The carrier cut part may be provided at the edge of the bottom plate that projects in the concave part at the bottom plate.

By this structure, the carrier cut part is provided to the bottom plate that projects in the concave part provided to the side plate. Therefore, for example, as compared to the case in which the concave part is not provided to the side plate, the stress generated in the side plate when the carrier cut part is provided to the edge of the bottom plate by the cutting can be suppressed.

That is to say, the deformation of the side plate in the terminal connection part can be suppressed and the connection reliability between the terminal connection part and the counterpart terminal can be improved. Even if the carrier cut part is in contact with the inner surface of the housing in inserting the terminal into the housing, the influence of the stress, which results from the contact with the carrier cut part, on the side plate can be suppressed.

The side plate may include an elastic piece that is in elastic contact with the counterpart terminal.

If the side plate has the elastic piece that is in elastic contact with the counterpart terminal, the deformation of the side plate may deteriorate the connection reliability between the terminal connection part and the counterpart terminal. However, since the carrier cut part is provided to the bottom plate that projects in the concave part provided to the side plate and the stress on the side plate can be suppressed, it is very advantageous in the connection reliability between the terminal connection part and the counterpart terminal.

A reinforcement part that reinforces the bottom plate may be provided in a part of the bottom plate where the carrier cut part is provided.

By this structure, even in the state before the carrier cut part is formed by the cutting, the part where the carrier cut part is to be formed is reinforced; therefore, the falling of the terminal because the position of the carrier cut part is cut due to, for example, the contact of another member can be suppressed.

Another aspect of the technology disclosed herein is a chain terminal including a terminal including a terminal connection part with a bottom plate, and a carrier with a belt shape that is formed integrally with the bottom plate of the terminal connection part and has a plurality of the terminals coupled thereto. The bottom plate and the carrier are separated by a concave groove formed at a bottom surface of a border between the bottom plate and the carrier, the concave groove being formed recessed along an entire width of the bottom surface.

By the chain terminal with such a structure, the concave groove is formed along the entire width at the position where the bottom plate and the carrier are cut; therefore, the part where the bottom plate and the carrier are cut is in the part on the opposite surface that is away from the bottom surface of the bottom plate.

Therefore, even if the projection such as burr is formed due to the cutting at the cut part, the outward protrusion of the projection from the bottom surface of the bottom plate can be suppressed. That is to say, when the terminal separated from the chain terminal is contained in the housing, the shaving of the inner surface of the housing by the projection can be suppressed. Furthermore, the increase of the resistance in inserting the terminal can be suppressed.

A reinforcement part that reinforces an area where the concave groove is provided may be provided to the bottom plate and the carrier.

By this structure, the part where the concave groove is formed in the state before the terminal and the carrier are separated by cutting can be reinforced. That is to say, the part where the strength between the bottom plate and the carrier has decreased because of the formation of the concave groove can be reinforced. Accordingly, the falling of the terminal from the carrier due to, for example, the contact of another member can be suppressed.

The concave groove may be larger in a direction where the terminal and the carrier are coupled than a plate thickness of the bottom plate and formed along an entire width of the border between the bottom plate and the carrier.

By this structure, the concave groove is larger in the direction where the terminal and the carrier are coupled; therefore, the accuracy of the cutting position between the bottom plate and the carrier can be relieved. That is to say, the cutting position can be adjusted more easily and the productivity can be improved.

The concave groove may be smaller in the direction where the terminal and the carrier are coupled than the plate thickness of the bottom plate and formed along the entire width of the border between the bottom plate and the carrier.

By this structure, the bottom plate and the carrier are separated by cutting with the higher accuracy of the cutting position between the bottom plate and the carrier; therefore, the dimensional accuracy of the separated terminal can be improved.

According to the technology disclosed herein, when the terminal is contained in the housing, the increase of the resistance in inserting the terminal can be suppressed and the damage of the housing can be prevented.

DETAILED DESCRIPTION

First Embodiment

A first embodiment of the technology disclosed herein is described with reference to FIG. 1 to FIG. 19.

The present embodiment describes a connector 60 including a housing 40 that is formed of synthetic resin and a female terminal (one example of "terminal") 10 that is contained in a cavity 41 provided to the housing 40.

Figure 1:
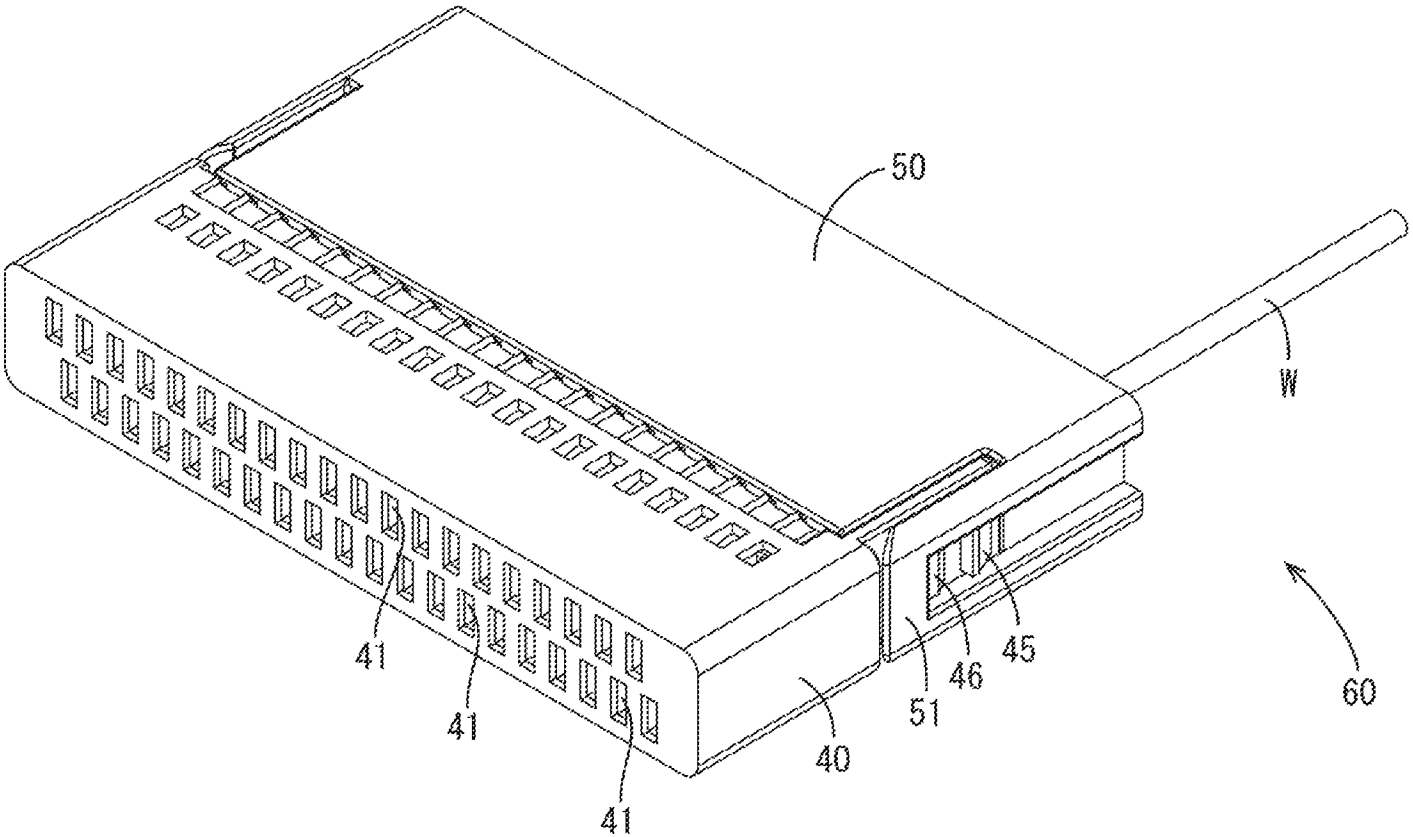
FIG. 1 is a perspective view of a connector according to a first embodiment.
Figure 2:
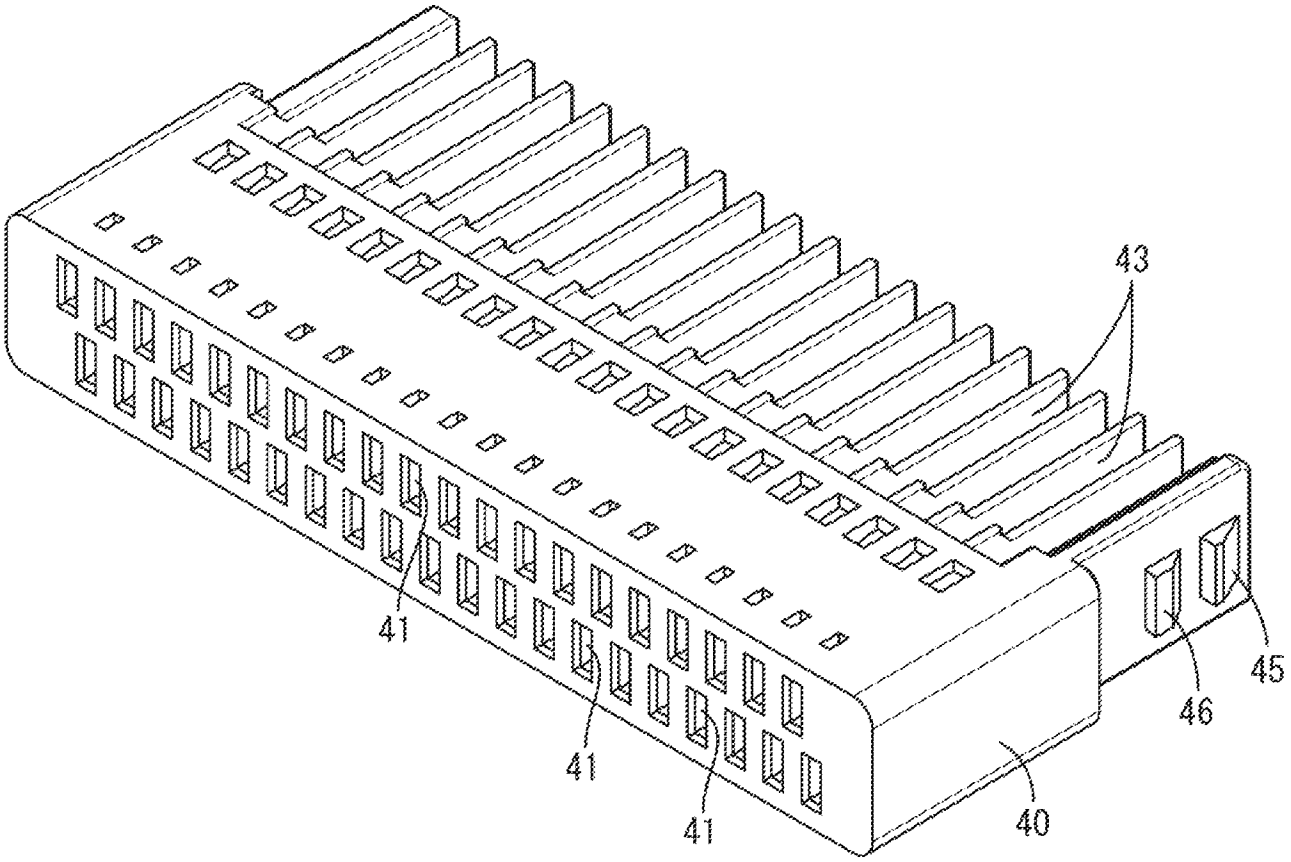
FIG. 2 is a perspective view of a housing according to the first embodiment.

The housing 40 has an approximately rectangular parallelepiped shape that is flat in an up-down direction and extended in a right-left direction as illustrated in FIG. 1 and FIG. 2. The housing 40 is formed through injection molding of synthetic resin with an insulating property. The housing 40 includes a plurality of cavities 41 that contains the female terminal 10. The cavities 41 are extended in a front-back direction, arranged with a space in the right-left direction, and provided in two stages vertically. The cavities 41 in the upper stage and the cavities 41 in the lower stage are arranged displaced from each other in the right-left direction.

Figure 9:
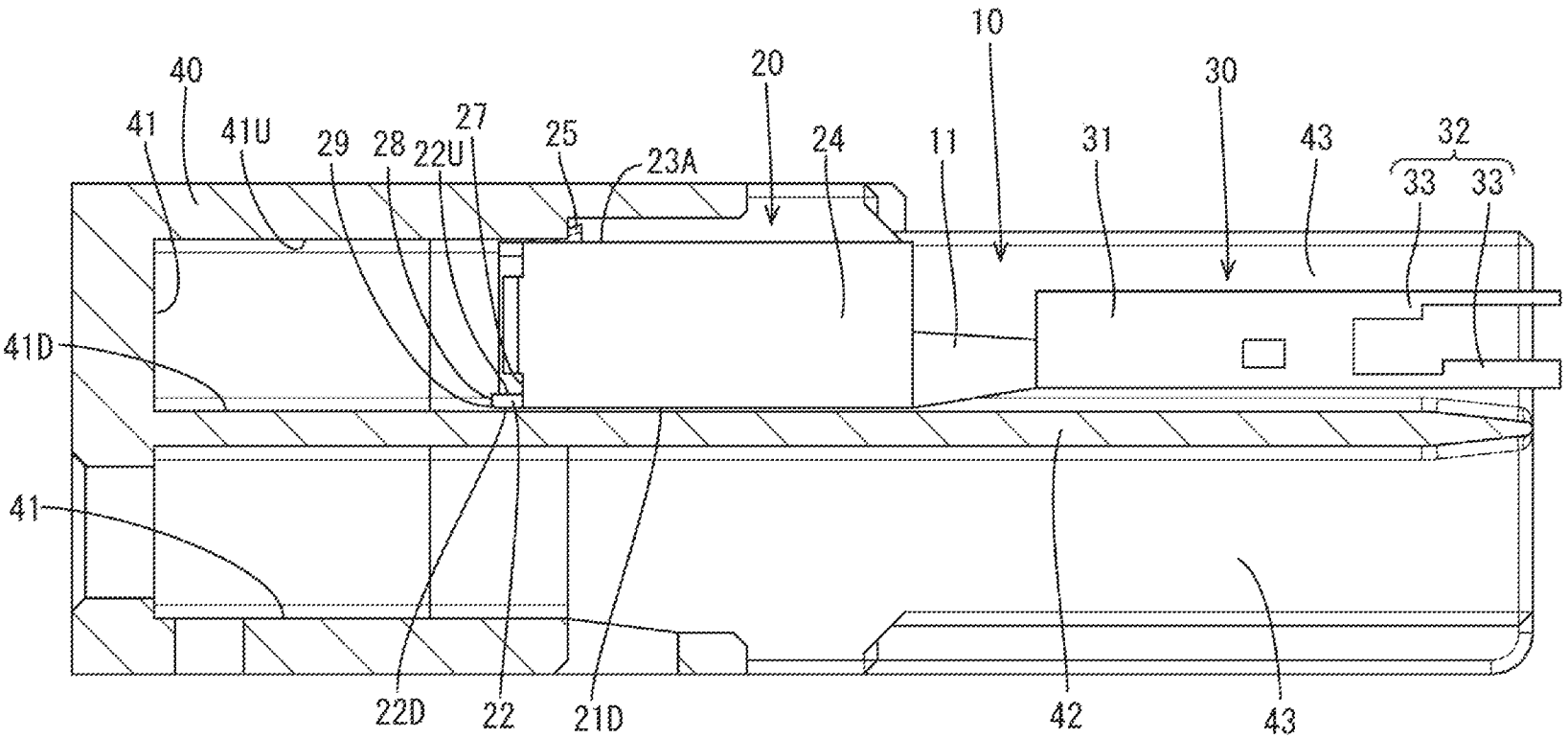
FIG. 9 is a cross-sectional view illustrating a state in which the female terminal is inserted shallowly into the housing.
Figure 10:
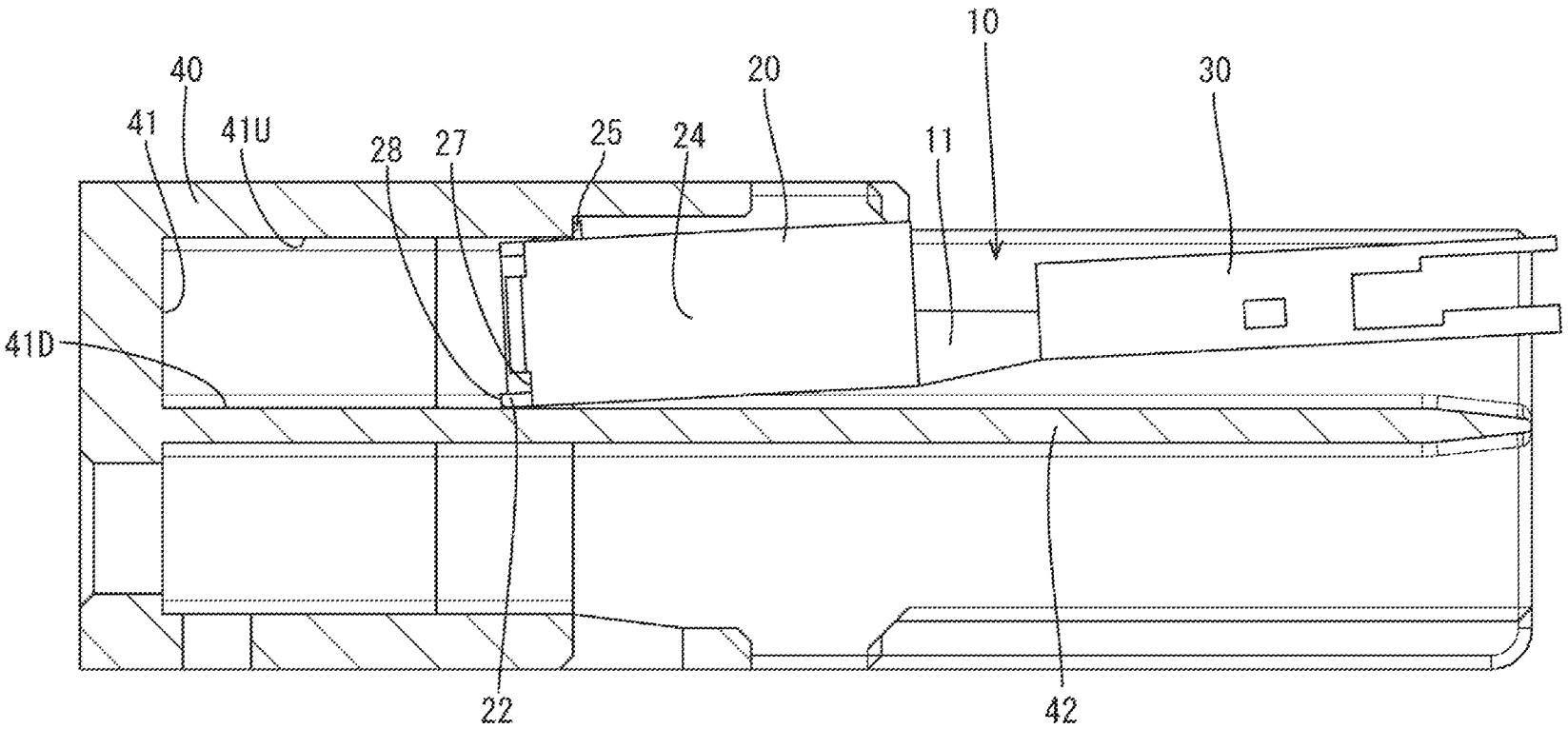
FIG. 10 is a cross-sectional view illustrating a state in which the female terminal is in an inclined posture in the housing.

The cavities 41 are formed long in the front-back direction and open at a front end and a rear end as illustrated in FIG. 9 and FIG. 10. The cavities 41 can have a male terminal, which is not shown, inserted thereinto from the opening at the front end, and the female terminal 10 inserted thereinto from the opening at the rear end of the cavities 41.

The housing 40 includes a partition wall 42 that sections horizontally between the cavities 41 formed in the upper stage and the cavities 41 formed in the lower stage. The partition wall 42 is extended to the rear from the rear end part of the cavities 41. At an upper surface and a lower surface of the partition wall 42, a sectioning wall 43 for sectioning the cavities 41, which are adjacent to each other in the right-left direction, into the right and left cavities. The sectioning wall 43 plays a role of electrically insulating the female terminals 10 contained in the cavities 41 that are adjacent to each other in the right-left direction.

The housing 40 can have a rear holder 50 attached at its rear end part as illustrated in FIG. 1. At each side wall of the housing 40 in the right-left direction, a temporary engagement lock part 45 and a final engagement lock part 46 are provided. As a lock reception part 51 in the rear holder 50 is engaged with the temporary engagement lock part 45 and the final engagement lock part 46 in the front-back direction, the rear holder 50 is held at a temporary engagement position or a final engagement lock position.

The female terminal 10 is formed by processing, for example pressing, a metal plate with conductivity. As the metal of the female terminal 10, arbitrary metal such as copper, copper alloy, aluminum, aluminum alloy, or stainless steel can be selected as necessary. The female terminal 10 according to the present embodiment is formed of copper or copper alloy. The female terminal 10 may have a surface thereof provided with a plating layer. As the metal forming the plating layer, arbitrary metal such as tin, nickel, or silver can be selected as necessary. The female terminal 10 according to the present embodiment may have a surface thereof provided with a tin plating layer.

Figure 3:
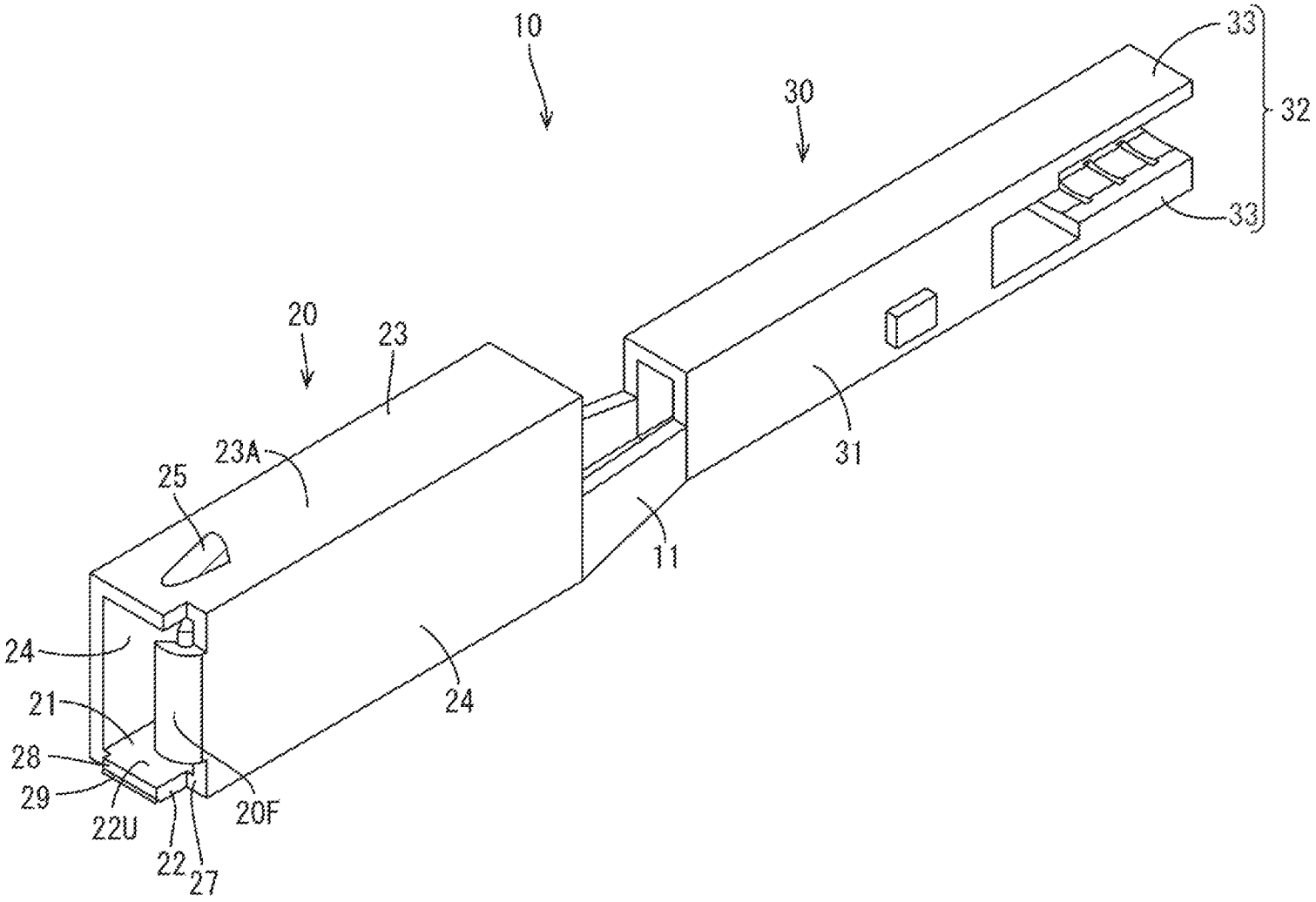
FIG. 3 is a perspective view of a female terminal according to the first embodiment.
Figure 5:
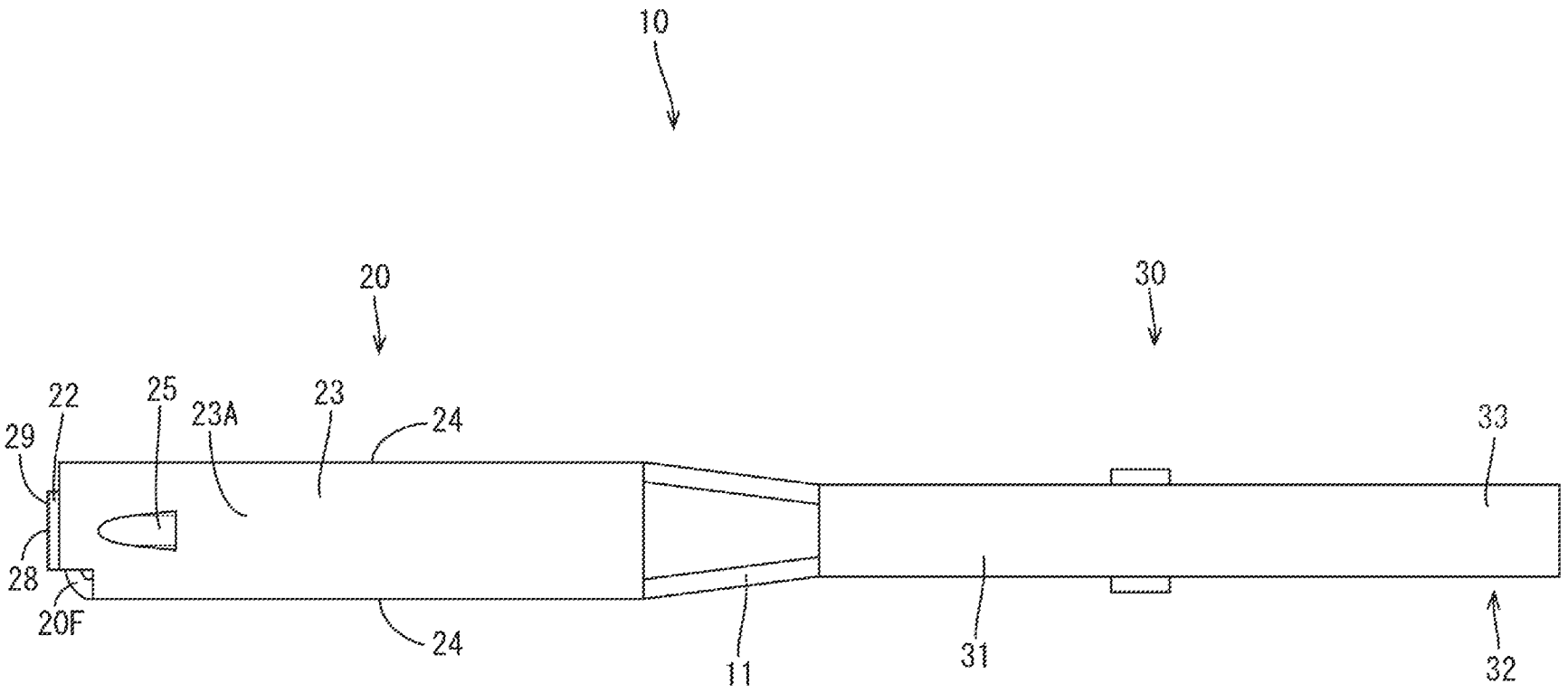
FIG. 5 is a plan view of the female terminal.
Figure 6:
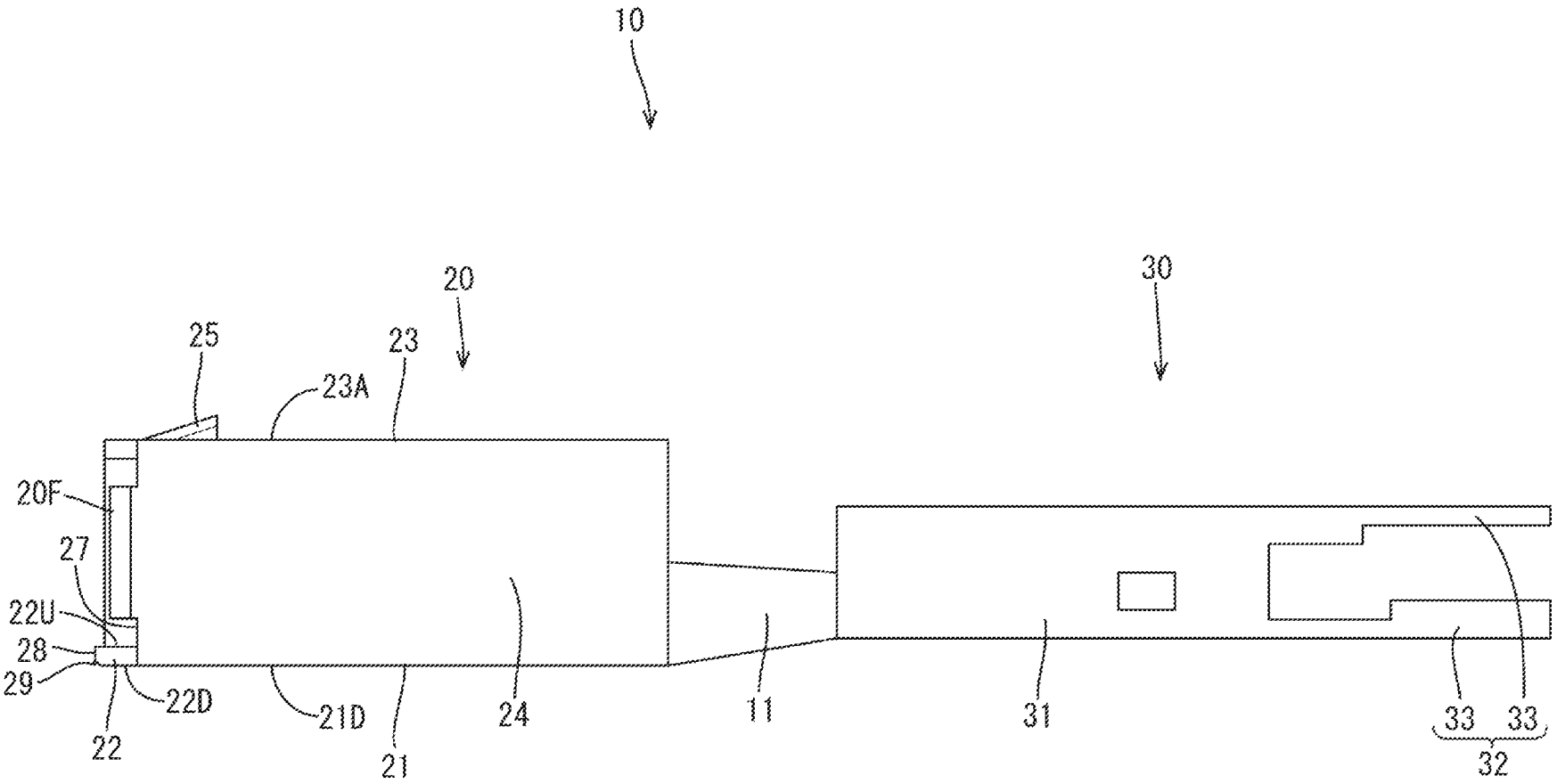
FIG. 6 is a side view of the female terminal.

As illustrated in FIG. 3, FIG. 5, and FIG. 6, the female terminal 10 includes a connection tubular part (one example of "terminal connection part") 20 to which a male terminal (one example of "counterpart terminal") that is not shown is inserted from the front, an electric line connection part 30 to which an electric line W is connected, and a linking part 11 that links between the connection tubular part 20 and the electric line connection part 30 in the front-back direction.

The electric line connection part 30 includes a main body part 31 with a rectangular tubular shape, and has a core line holding part 32 at a rear end part of the main body part 31. The core line holding part 32 includes a pair of holding pieces 33 that holds the core line of the electric line W from both sides in the up-down direction.

The pair of holding pieces 33 is extended to the rear from an upper plate and a lower plate of the main body part 31 as illustrated in FIG. 3 and FIG. 6. The pair of holding pieces 33 is elastically deformable in a direction of approaching each other with a base end part used as a fulcrum.

The electric line connection part 30 has a covering part, which is not shown, covering an outer surface of the electric line connection part 30 in a manner that the covering part is externally fitted to the electric line connection part 30. The covering part is assembled so as to cover the electric line connection part 30 after the core line of the electric line W is inserted from the rear between the pair of holding pieces 33. The covering part presses the pair of holding pieces 33 in a direction of getting the holding pieces 33 close to each other and brings the core line and the pair of holding pieces 33 in contact with each other. Thus, the electric line W and the female terminal 10 are electrically connected.

On the other hand, as illustrated in FIG. 3 to FIG. 8, the connection tubular part 20 has a rectangular tubular shape with an approximately rectangular shape in the front view that is extended in the front-back direction, and includes a bottom plate 21, a ceiling plate 23 that faces the bottom plate 21 in the up-down direction, and a pair of side plates 24 that couples, in the up-down direction, both side edges of the bottom plate 21 in the right-left direction and both side edges of the ceiling plate 23 in the right-left direction. The bottom plate 21, the ceiling plate 23, and the pair of side plates 24 form the rectangular tubular shape that opens in the front-back direction.

On an outer surface (upper surface) 23A of the ceiling plate 23 of the connection tubular part 20, an engagement projection 25 that increases in width toward the rear is provided so as to project.

The engagement projection 25 has an approximately halved conical shape, and as illustrated in FIG. 9 to FIG. 12, when the female terminal 10 is inserted into the cavity 41 in the housing 40, the female terminal 10 is press-fitted into an upper inner surface 41U of the cavity 41 such that the female terminal 10 is kept within the cavity 41.

Figure 8:
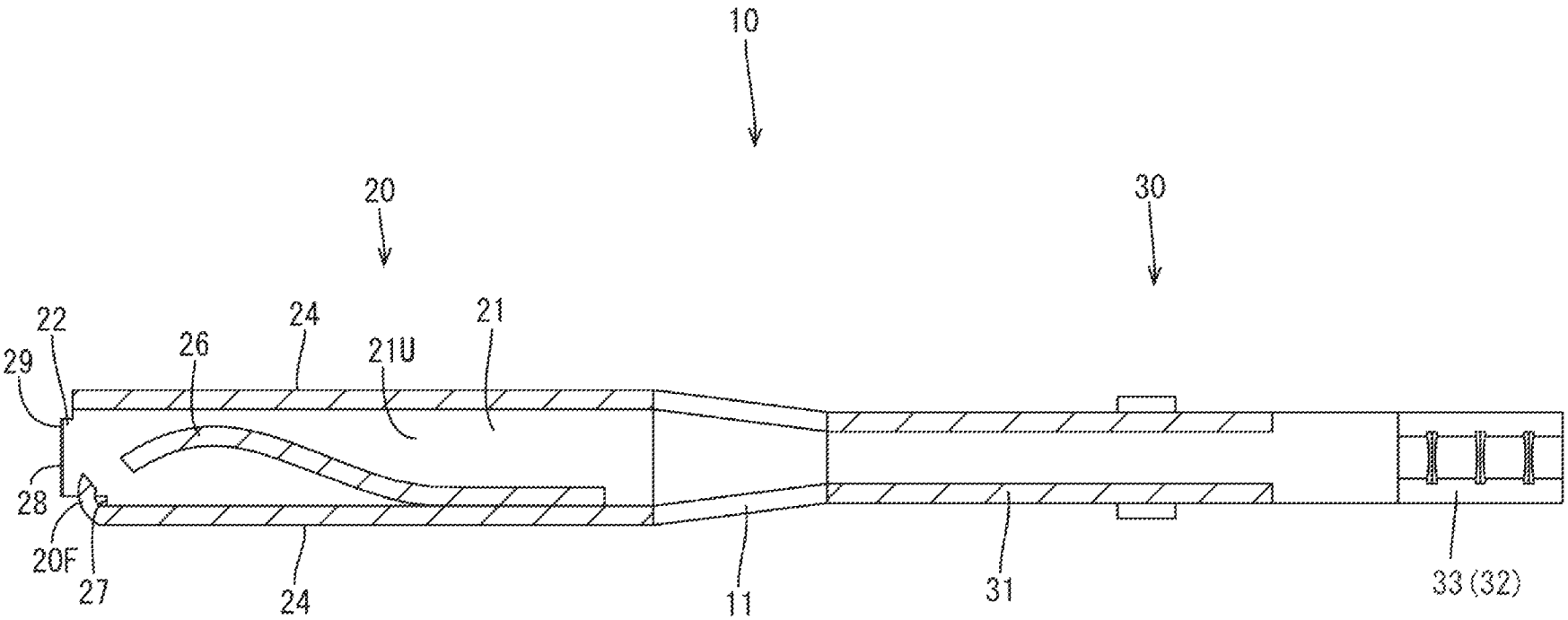
FIG. 8 is a cross-sectional view taken along line A-A in FIG. 4.

In the connection tubular part 20, as illustrated in FIG. 8, the male terminal can be inserted from an opening at a front end, and inside the connection tubular part 20, an elastic piece 26 that is in elastic contact with the male terminal inserted into the connection tubular part 20 is provided.

The elastic piece 26 is provided to one side plate 24 of the pair of side plates 24 (in the present embodiment, the side plate 24 on the right side in the front view).

The elastic piece 26 is formed to have a cantilever shape with a rear end part in contact with the inner surface of the side plate 24 and a front end part serving as a free end. When the male terminal is inserted into the connection tubular part 20 from the front, the elastic piece 26 is elastically brought into contact with the male terminal, and this contact causes the male terminal and the female terminal 10 to be electrically connected.

Figure 4:
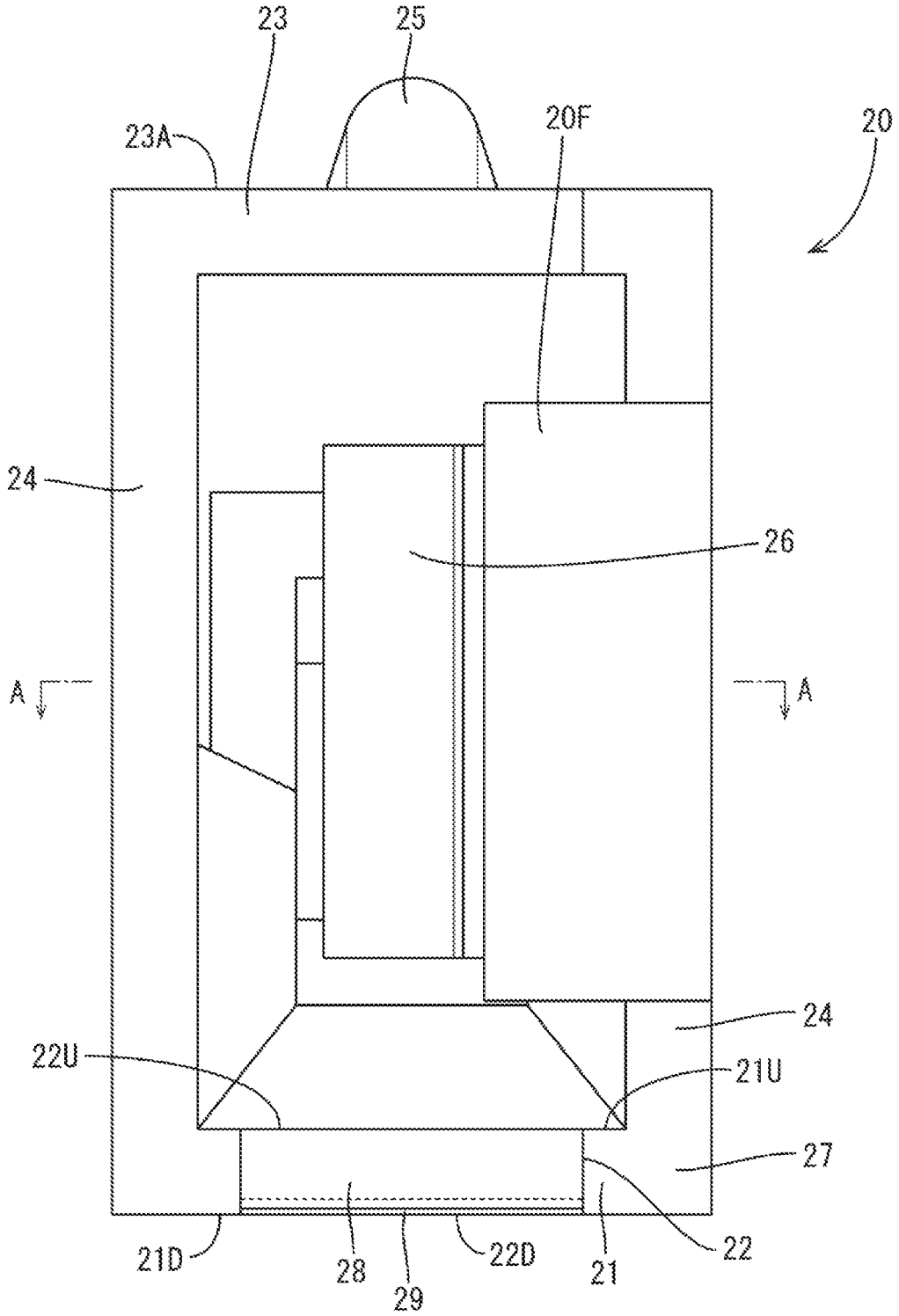
FIG. 4 is a front view of the female terminal.

A front edge of the pair of side plates 24 is provided with a front plate 20F as illustrated in FIG. 3 and FIG. 4. The front plate 20F is extended in the right-left direction that is orthogonal to the side plate 24.

At a lower end part of the front edge of the pair of side plates 24 on the bottom plate 21 side, a concave part 27 is provided as illustrated in FIG. 3, FIG. 4, FIG. 6, and FIG. 7.

The concave part 27 is formed to have an approximately rectangular concave shape that opens at a front edge and a lower edge of the side plate 24, and in the concave part 27, the bottom plate 21 of the connection tubular part 20 projects from the rear. The bottom plate 21 that projects in the concave part 27 is referred to as a projecting bottom plate 22. The projecting bottom plate 22 projects a little forward over the front plate 20F of the connection tubular part 20 as illustrated in FIG. 5 to FIG. 8.

A front edge of the projecting bottom plate 22 that projects in the concave part 27 of the connection tubular part 20 includes a carrier cut part 28 as illustrated in FIG. 3 to FIG. 8. In a process of producing the female terminal 10, for example, a pressing process is performed to cut between the projecting bottom plate 22 and a coupling part 82 of a carrier 81, which is described below, and this cutting trace is left as the carrier cut part 28.

The carrier cut part 28 is formed at an edge part of the projecting bottom plate 22 on a side of an upper surface 22U thereof that is opposite to the bottom surface 22D (one example of surface opposite to bottom surface 22D) along the plate thickness of the projecting bottom plate 22.

Figure 7:
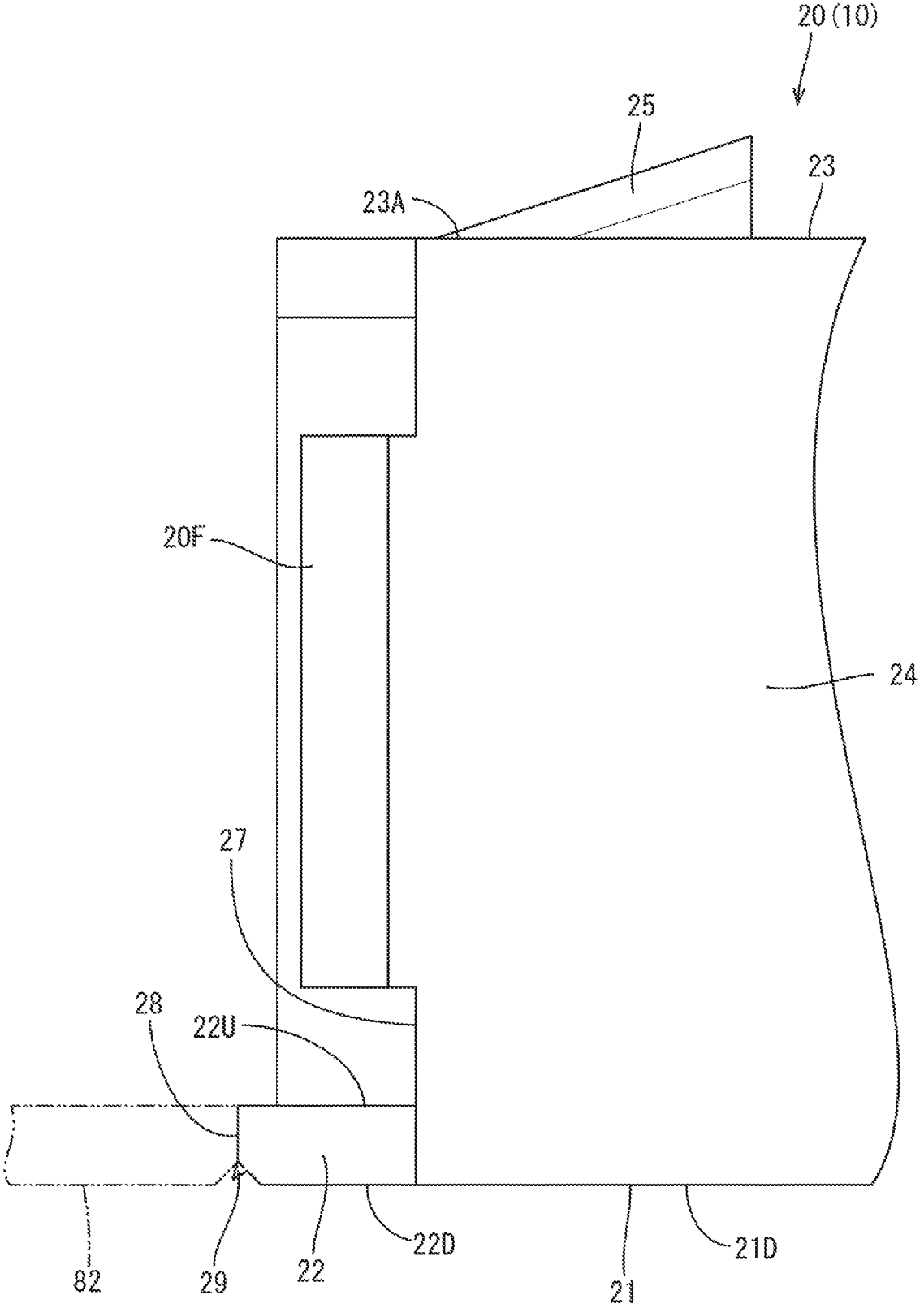
FIG. 7 is a magnified side view of a main part of FIG. 6.

At a front edge of the carrier cut part 28, a projection 29 that slightly projects obliquely forward and downward is formed as illustrated in FIG. 6 and FIG. 7. The projection 29 is what is called burr that is formed at the front edge of the carrier cut part 28 when the coupling part 82 of the carrier 81 and the projecting bottom plate 22 are cut apart. In addition, regarding the projection 29, the carrier cut part 28 is formed at the end part of the projecting bottom plate 22 on the upper surface 22U side. Therefore, the projection 29 is provided on the upper side compared to the bottom surface 22D of the projecting bottom plate 22. In other words, the projection 29 is formed so as not to project downward below the bottom surface 22D of the projecting bottom plate 22.

Next, in addition to one example of a producing method for the female terminal 10, the carrier cut part 28 is described.

To produce the female terminal 10, first, a metal plate material, which is not shown, is punched and bent through pressing, for example, and thus, a chain terminal 80 as illustrated in FIG. 13 to FIG. 17 is formed.

Figure 18:
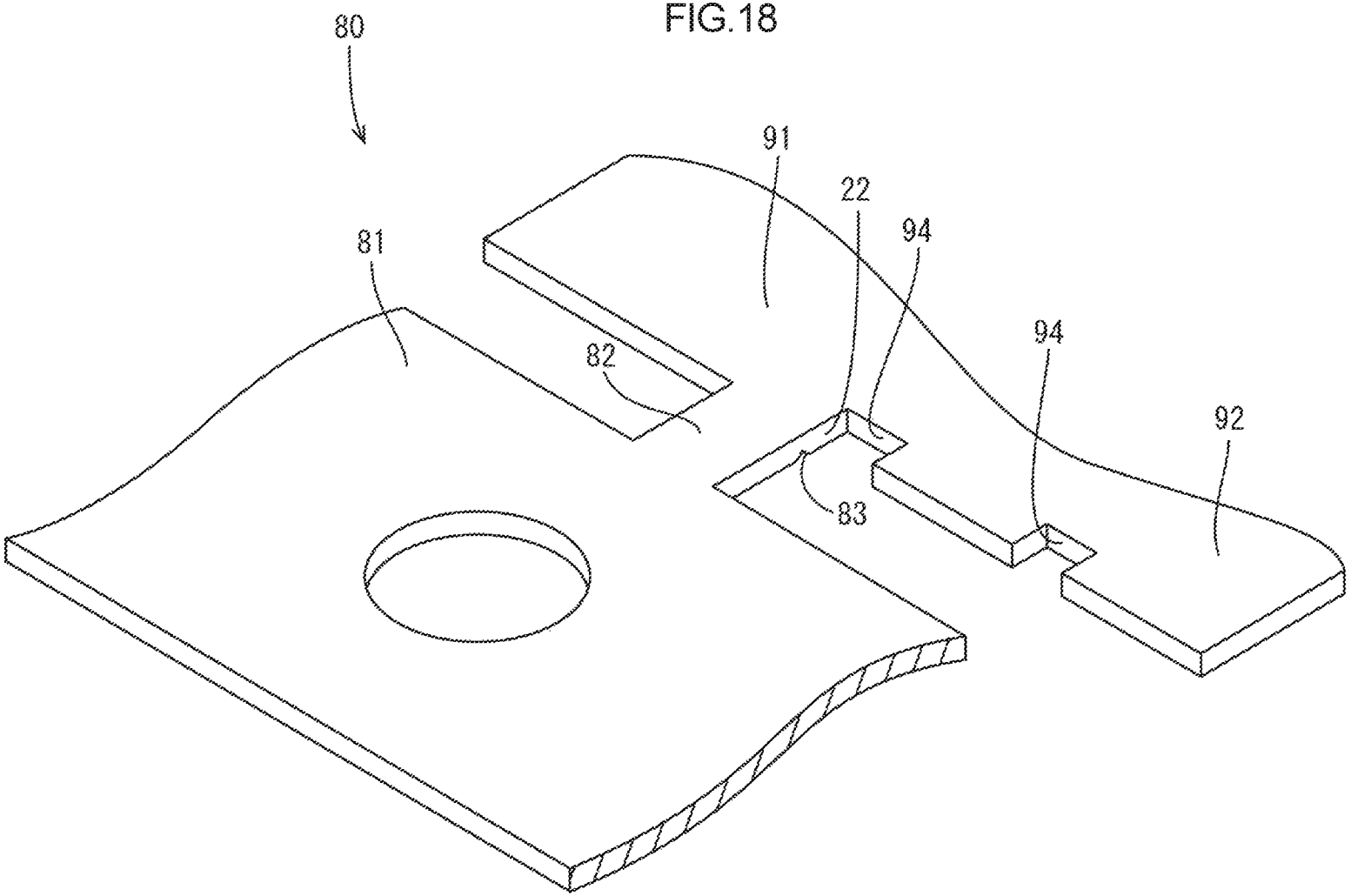
FIG. 18 is a magnified perspective view of a main part of the chain terminal in a developed state.
Figure 19:
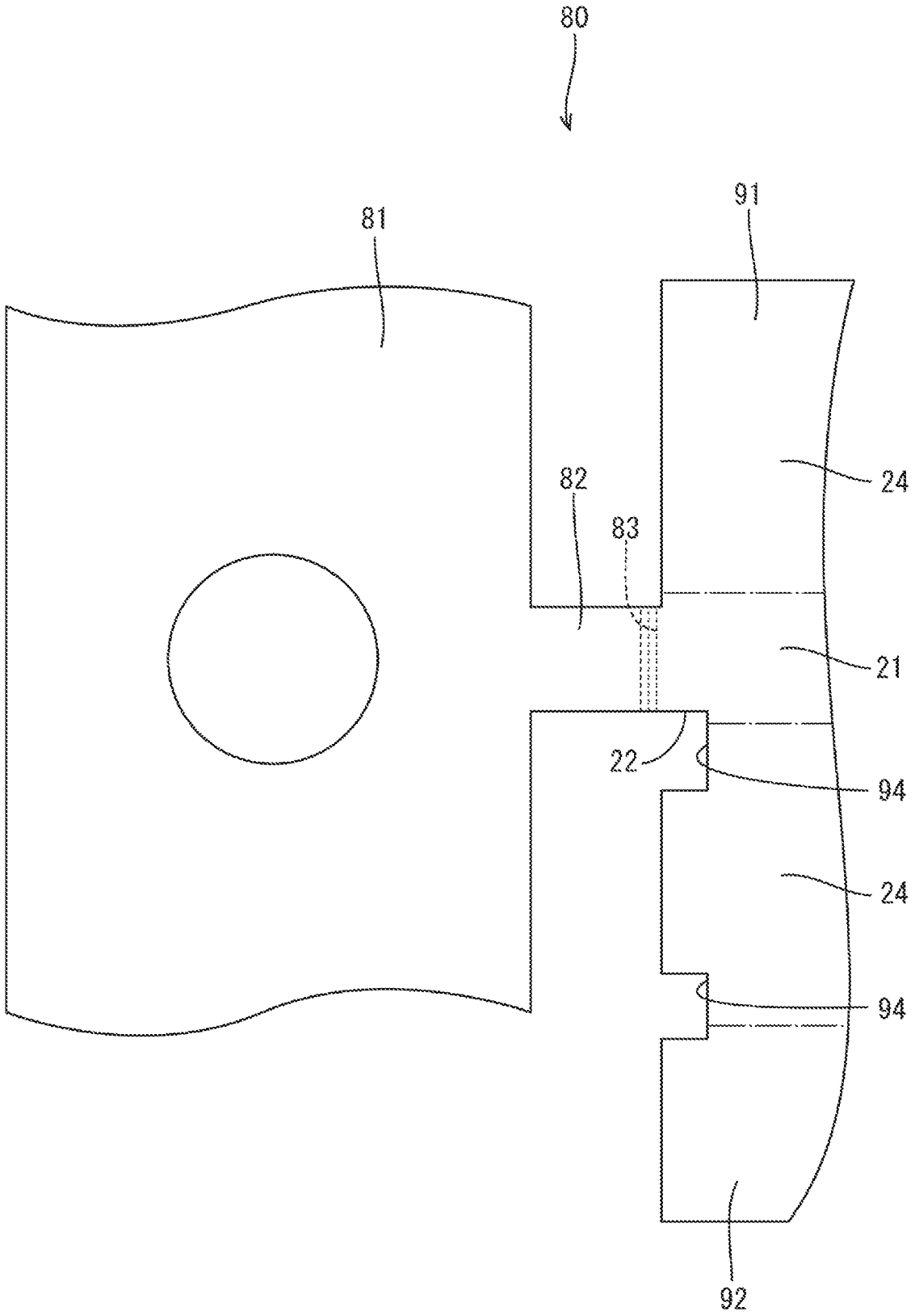
FIG. 19 is a magnified plan view of the main part of the chain terminal in the developed state.

The chain terminal 80 has, by punching the metal plate material, a form including the carrier 81 with a belt-like shape and a plurality of terminal pieces 91, which is coupled to the coupling parts 82 of the carrier 81, as illustrated in FIG. 18 and FIG. 19.

The terminal piece 91 includes a tubular piece 92 forming the connection tubular part 20 of the female terminal 10, and a connection piece, which is not shown, forming the electric line connection part 30. At a border between the coupling part 82 of the carrier 81 and a part of the connection tubular part 20 that forms the projecting bottom plate 22, a concave groove 83 that is recessed with a notch shape is formed.

Figure 17:
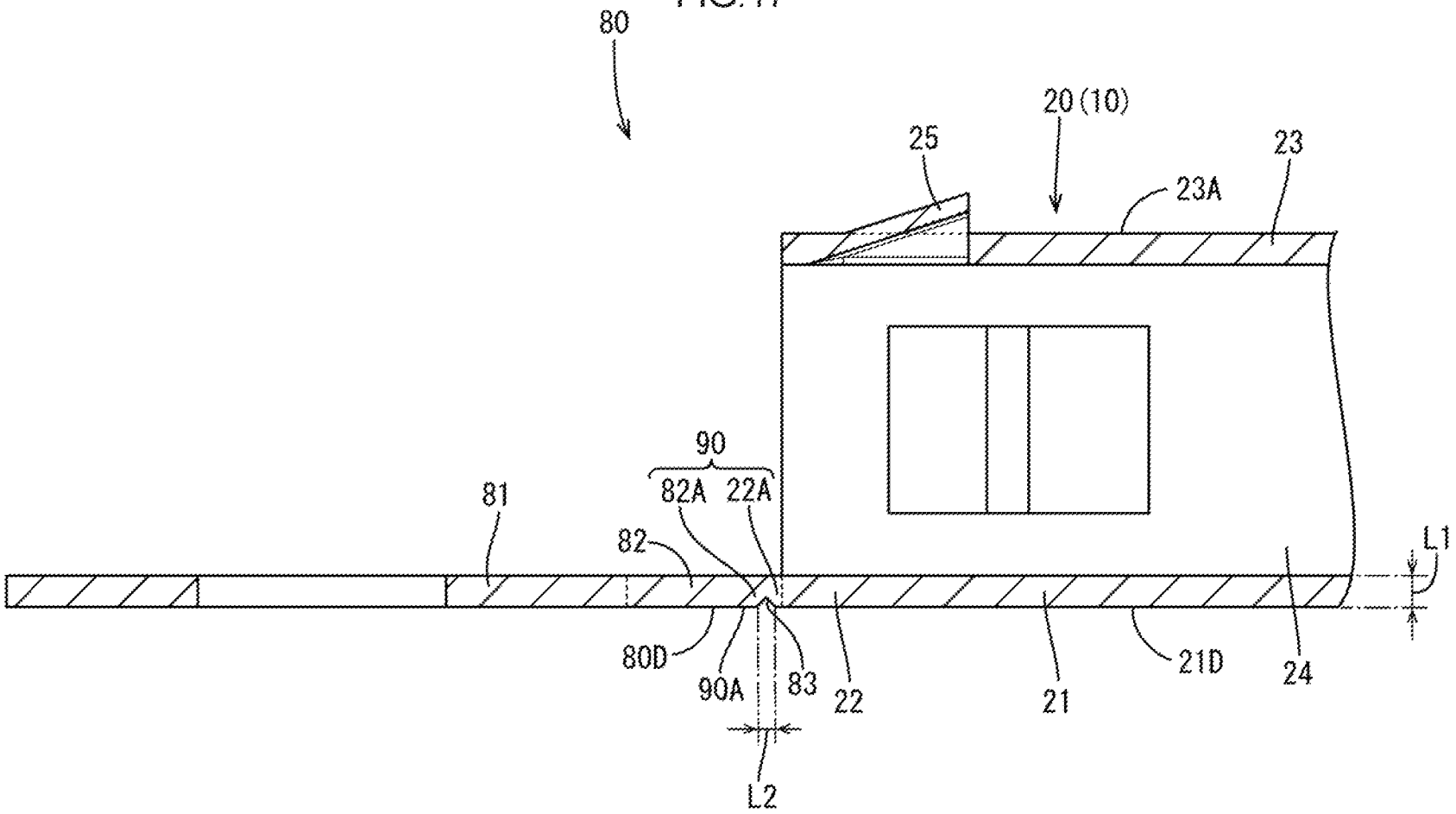
FIG. 17 is a cross-sectional view taken along line B-B in FIG. 15.

The concave groove 83 is formed when the metal plate material is punched through pressing or the like. The concave groove 83 is formed to have, when viewed from a side, a triangular shape recessed upward from a bottom surface 80D at the border between the part forming the projecting bottom plate 22 and the coupling part 82 of the carrier 81 as illustrated in FIG. 18 and FIG. 19. The concave groove 83 is formed along the entire width in the right-left direction in a state where a length L2 in the front-back direction (direction where the female terminal 10 and the carrier 81 are coupled) is smaller in the front-back direction than a plate thickness L1 of the projecting bottom plate 22 as illustrated in FIG. 17.

In addition, a slit 94 is formed at each of both end parts of the front edge of the part forming the pair of side plates 24 as illustrated in FIG. 18 and FIG. 19.

After the metal plate material is punched, the tubular piece 92, the connection piece, and the like are subjected to a predetermined bending process; thus, the chain terminal 80 with the plurality of female terminals 10 coupled to the carrier 81 is formed as illustrated in FIG. 13 to FIG. 17.

Here, the slit 94 is formed at each of both end parts of the part forming the pair of side plates 24. Therefore, the slits 94 can reduce the bending stress on the side plates 24 when the front plate 20F of the connection tubular part 20 is formed by the bending process. Thus, while the warpage of the side plates 24 is reduced, the front plate 20F of the connection tubular part 20 can be formed.

At the lower end part of the front edge of the side plate 24 of the connection tubular part 20, the concave part 27 is formed by the slit 94 in the part forming the side plate 24. Thus, in the concave part 27, the projecting bottom plate 22 projects from the rear.

Next, in order to separate the female terminal 10 from the coupling part 82 of the carrier 81 of the chain terminal 80, the chain terminal 80 is conveyed by a feeding step of feeding the carrier 81 forward and then the border between the projecting bottom plate 22 and the coupling part 82 of the carrier 81 is cut by a cutting step of cutting between the female terminal 10 and the coupling part 82 of the carrier 81. Thus, the female terminals 10 provided with the carrier cut parts 28 are formed continuously.

Figure 20:
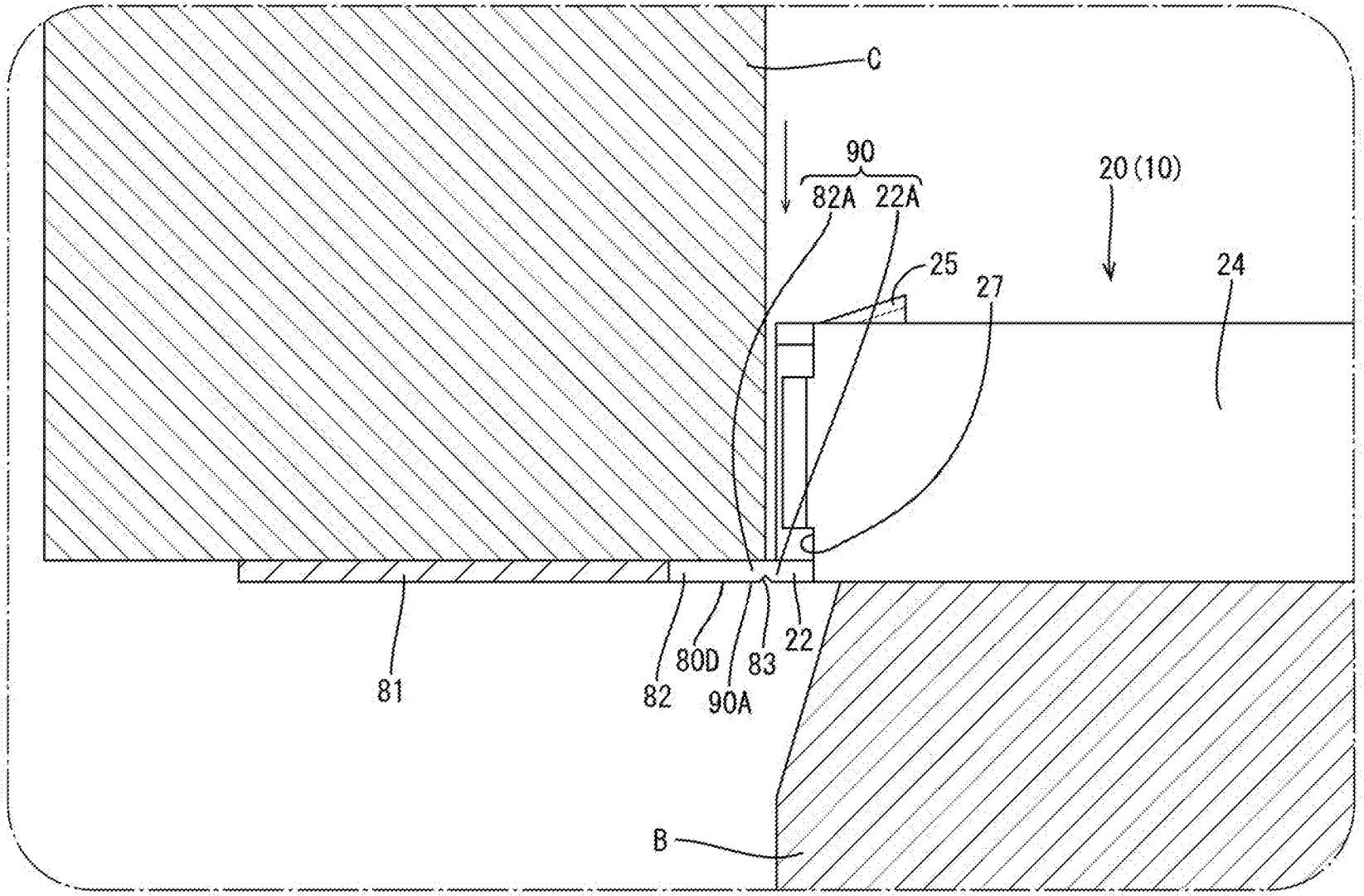
FIG. 20 is a side view illustrating a process for separating the female terminal of the chain terminal with a cutting blade.

Specifically, in the cutting step, the female terminal 10 is disposed on a base B in a manner that the front end part of the connection tubular part 20 slightly projects from an end part of the base B as illustrated in FIG. 20.

Next, a cutting blade C, which cuts the projecting bottom plate 22 and the coupling part 82 of the carrier 81, is displaced downward along a side surface of the base B until the female terminal 10 is separated from the chain terminal 80.

Here, the position to cut by the cutting blade C is the part where the concave groove 83 is provided between the projecting bottom plate 22 and the coupling part 82 of the carrier 81. The concave groove 83 has, when viewed from a side, a triangular shape recessed upward from the bottom surface 80D at the border between the projecting bottom plate 22 and the coupling part 82 of the carrier 81. The concave groove 83 is formed along the entire width in the right-left direction at the border between the projecting bottom plate 22 and the coupling part 82 of the carrier 81.

That is to say, the carrier cut part 28 formed by the cutting step is formed at the end part of the projecting bottom plate 22 of the connection tubular part 20 on the upper surface 22U side. When the carrier cut part 28 is formed, the projection 29 is formed due to the cutting at the front edge of the carrier cut part 28. This projection 29 is provided on the upper side compared to the bottom surface 22D of the projecting bottom plate 22.

Incidentally, when the border between the carrier 81 and the projecting bottom plate 22 is cut by the cutting blade C, a large force acts on the cut position. Therefore, if the position of the female terminal 10 or the position of the cutting blade C is deviated even a little from the base B, the stress is applied to the projecting bottom plate 22 and this may result in the deformation of the side plate 24 of the connection tubular part 20.

However, in the present embodiment, the concave part 27 is provided to the pair of side plates 24 of the connection tubular part 20, and the front edge of the projecting bottom plate 22 that projects in the concave part 27 is used as the cutting position (carrier cut part 28) with respect to the coupling part 82 of the carrier 81. Therefore, for example, as compared to the case in which the concave part is not provided to the pair of side plates 24, the application of the stress from the cutting blade C on the side plates 24 can be reduced.

That is to say, if the elastic piece 26 to be in contact with the counterpart terminal is provided to the side plate 24 as described in the present embodiment, the connection reliability between the counterpart terminal and the connection tubular part 20 may decrease due to the deformation of the side plate 24. However, in the present embodiment, the concave part 27 is provided to the side plate 24 of the connection tubular part 20 and the carrier cut part 28 is provided to the projecting bottom plate 22 that projects in the concave part 27; therefore, the stress on the side plate 24 can be suppressed. Thus, the decrease in connection reliability between the counterpart terminal and the connection tubular part 20 can be suppressed.

Finally, the covering part, which is formed separately, is assembled to the electric line connection part 30 of the female terminal 10; thus, the female terminal 10 with the covering part attached thereto is completed.

Next, a method for producing the connector 60 including the female terminal 10 formed by the above method is described and moreover, the operation and effect thereof are described.

Figure 12:
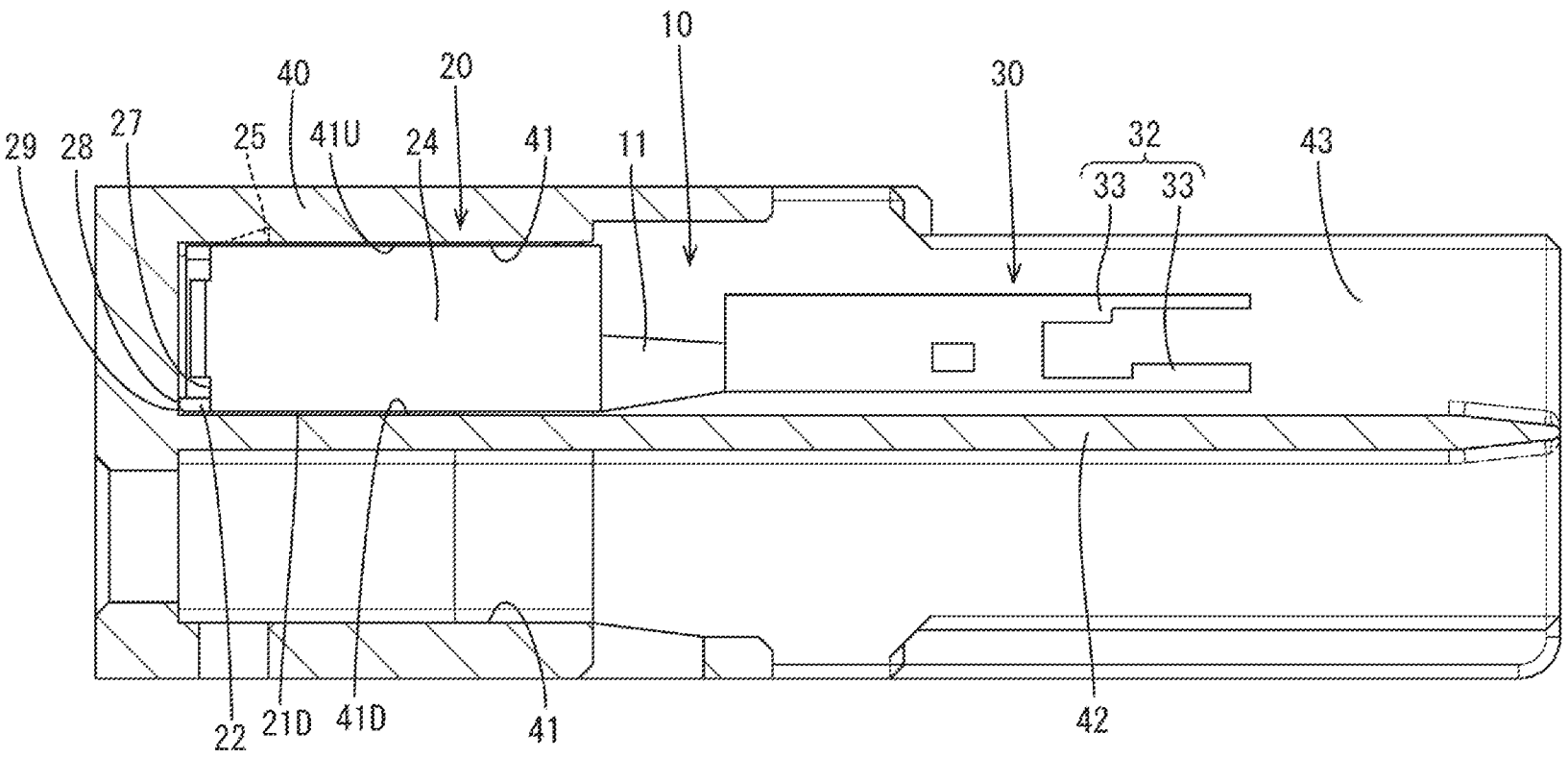
FIG. 12 is a cross-sectional view illustrating a state in which the female terminal is in a correct position of the housing.
Figure 13:
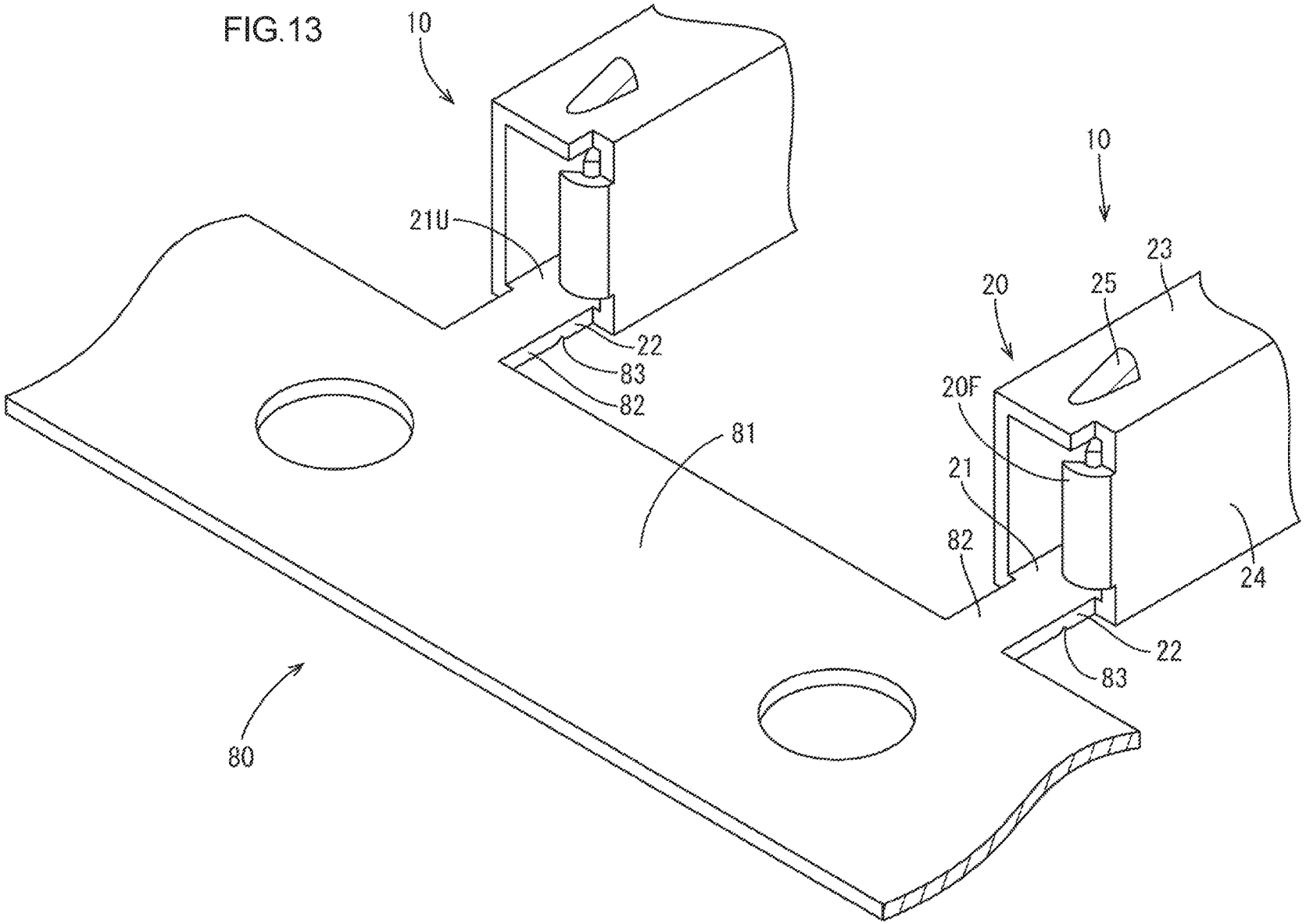
FIG. 13 is a magnified perspective view of a part of a chain terminal according to the first embodiment.
Figure 14:
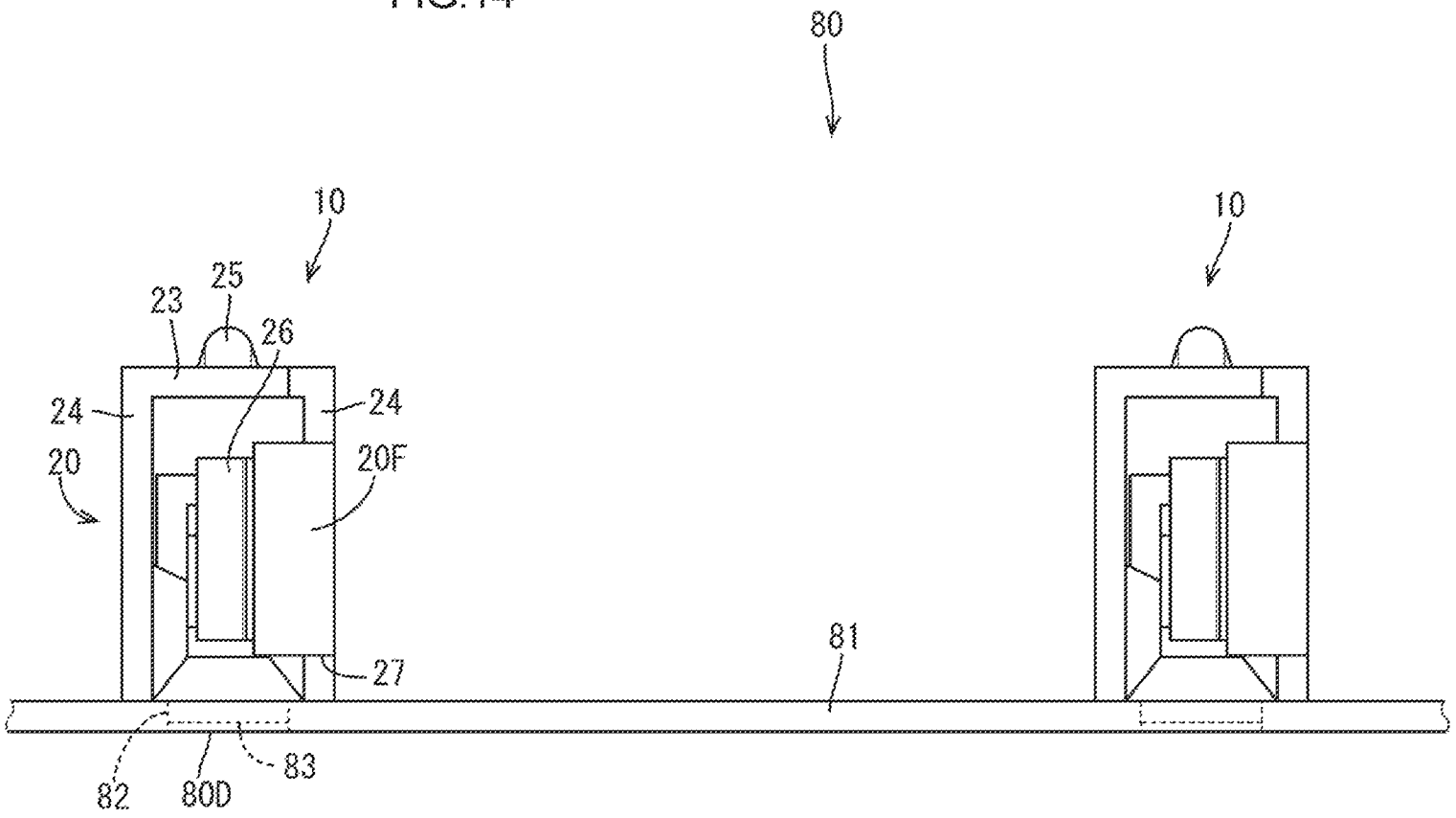
FIG. 14 is a magnified front view of a part of the chain terminal.
Figure 15:
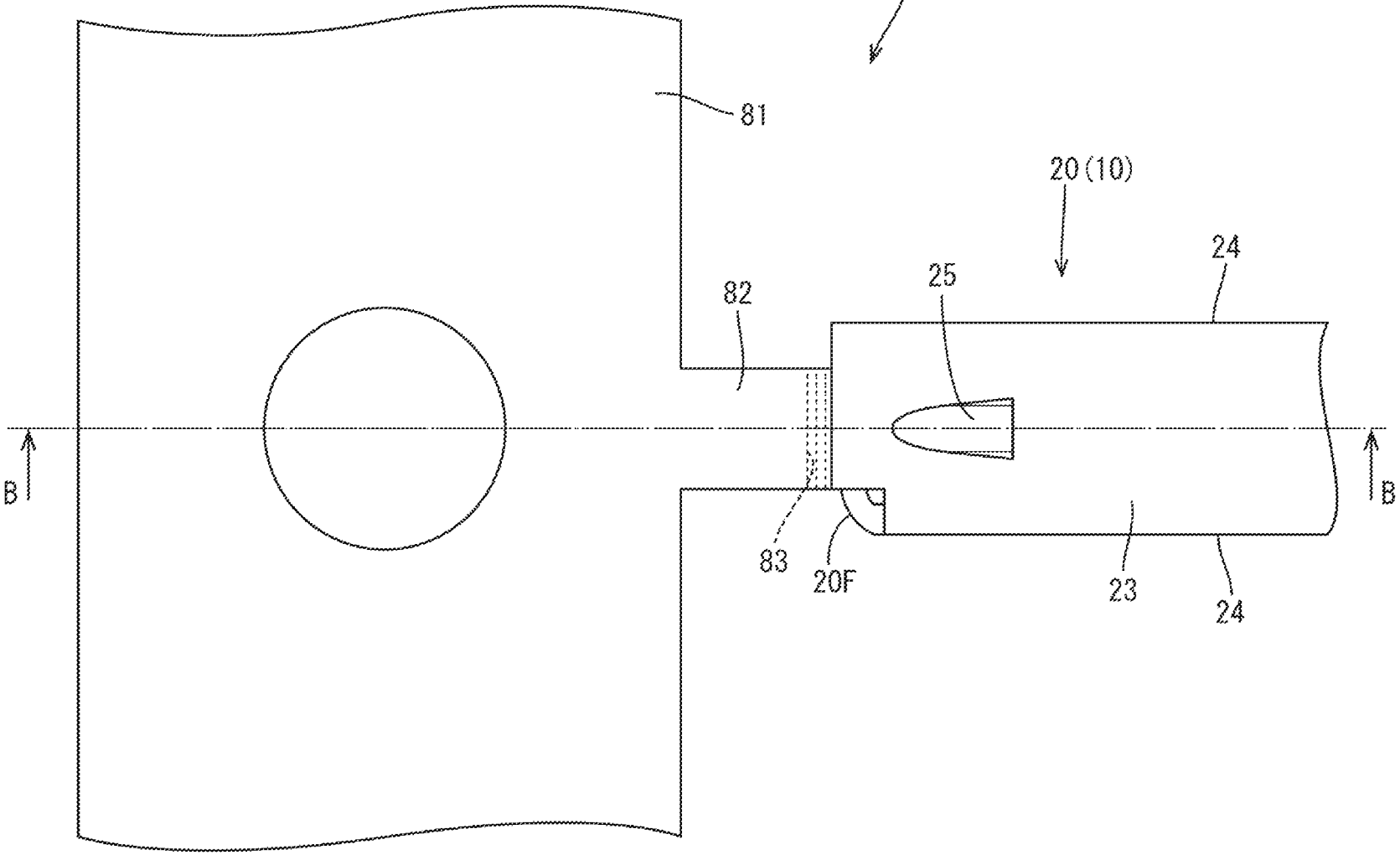
FIG. 15 is a magnified plan view of a part of the chain terminal.
Figure 16:
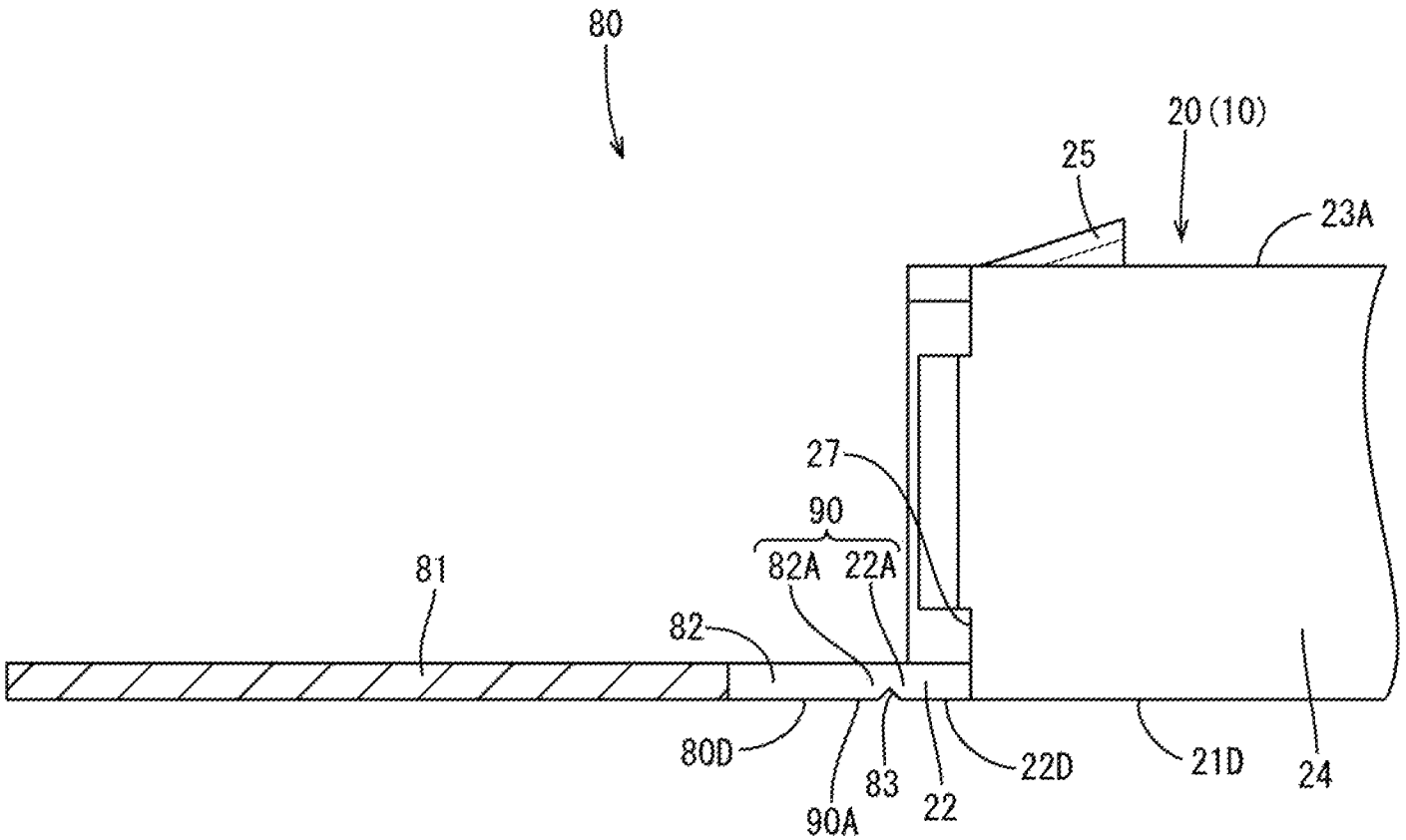
FIG. 16 is a magnified side view of a part of the chain terminal.

First, as illustrated in FIG. 9, the female terminal 10 is inserted into the cavity 41 from the opening at the rear end of the cavity 41 of the housing 40. Then, as illustrated in FIG. 12, when the female terminal 10 has reached the correct position in the cavity 41, the engagement projection 25 of the connection tubular part 20 is press-fitted into the upper inner surface 41U of the cavity 41 such that the female terminal 10 is kept within the cavity 41.

This inserting operation of the female terminal 10 is repeated until the female terminals 10 are inserted into all the cavities 41.

Here, if the projection formed at the carrier cut part at the projecting bottom plate of the terminal tubular part projects downward below the bottom surface of the projecting bottom plate, a lower inner surface of the cavity is shaved by the projection in the operation of inserting the female terminal and the housing is damaged. In addition, as the lower inner surface of the cavity is shaved by the projection, the resistance in inserting the female terminal may increase.

Incidentally, in the present embodiment, the concave groove 83 that has, when viewed from a side, the triangular shape that is recessed upward along the entire width in the right-left direction is formed on the bottom surface 80D at the border between the coupling part 82 of the carrier 81 and the projecting bottom plate 22 of the female terminal 10 in the chain terminal 80.

By cutting the part provided with this concave groove 83 with the cutting blade C from above, the carrier cut part 28 is formed at the end part of the front edge of the projecting bottom plate 22 on the upper surface 22U side and in the carrier cut part 28, the projection 29 is formed on the upper side compared to the bottom surface 22D of the projecting bottom plate 22.

That is to say, in the operation of inserting the female terminal 10 into the cavity 41 of the housing 40, the shaving of a lower inner surface 41D of the cavity 41 by the projection 29 of the female terminal 10 can be suppressed.

Figure 11:
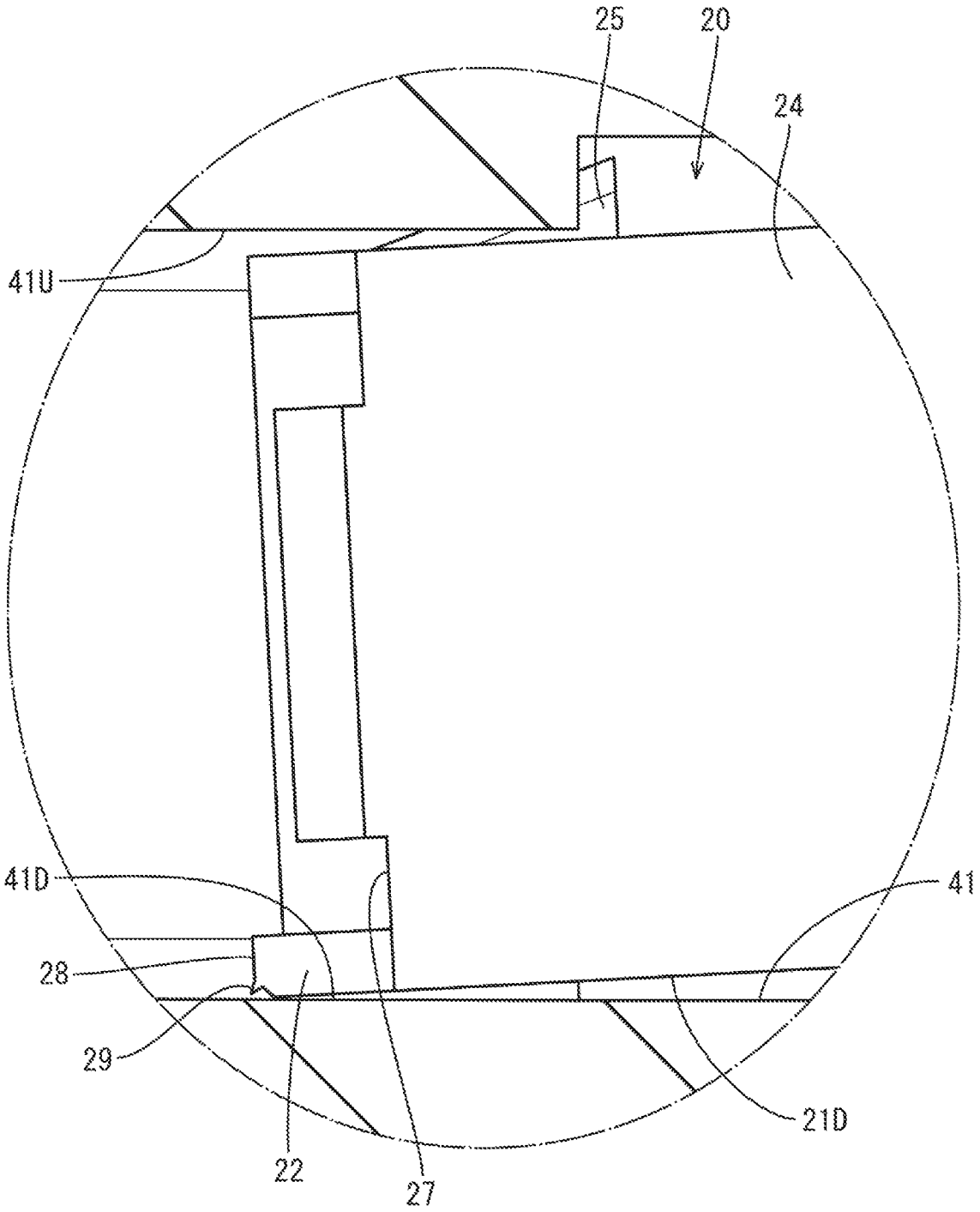
FIG. 11 is a magnified cross-sectional view of a main part of FIG. 10.

In addition, when the female terminal 10 according to the present embodiment is inserted into the cavity 41 of the housing 40, the engagement projection 25 of the connection tubular part 20 is press-fitted into the upper inner surface 41U of the cavity 41; thus, the female terminal 10 tends to be inserted with an inclined posture that the rear end of the female terminal 10 is slightly lifted up as illustrated in FIG. 10 and FIG. 11.

If the female terminal 10 is inserted into the cavity 41 with the inclined posture, the carrier cut part 28 is in contact with the lower inner surface 41D of the cavity 41 and the stress at the contact may be applied to the side plate 24.

In this regard, the female terminal 10 according to the present embodiment includes the carrier cut part 28 at the front edge of the projecting bottom plate 22 that projects in the concave part 27 in the pair of side plates 24 of the connection tubular part 20 and when the female terminal 10 is inserted into the cavity 41 with the inclined posture, this carrier cut part 28 is in contact with the lower inner surface 41D of the cavity 41; therefore, for example, as compared to the case in which the concave part is not provided to the pair of side plate, the stress at the contact is applied less on the pair of side plates 24.

As described above, the female terminal 10 according to the present embodiment is the female terminal 10 that is contained in the housing 40 and includes: the connection tubular part 20 provided to be connectable to the counterpart terminal and including the bottom plate 21; the carrier cut part 28 provided at the edge of the bottom plate 21; and the projection 29 projecting from the carrier cut part 28. The carrier cut part 28 is provided at the upper edge part opposite to the lower side corresponding to the housing 40 side along the plate thickness of the bottom plate 21. The projection 29 is provided to the side of the upper surface 21U (opposite to the bottom surface 21D) compared to the bottom surface 21D that is on the lower side in the bottom plate 21.

The chain terminal 80 according to the present embodiment includes the female terminals 10, the carrier 81, and the cutting portions 90. The female terminals 10 include the connection tubular parts 20 with the projecting bottom plates 22. The carrier 81 having the belt shape is formed integrally with the projecting bottom plates 22 of the connection tubular parts 20. The carrier 81 including coupling parts 82 that extend from a long edge of the carrier 81 adjacent to the connection tubular parts 20 to the projecting bottom plates 22. The female terminals 10 are coupled to the carrier 81. The cutting portions 90 include end portions 22A of the projecting bottom plates 22 and distal end portions 82A of the respective coupling parts 82 with bottom surfaces 90A. The bottom surfaces 90A include bottom surfaces of the end portions 22A of the projecting bottom plates 22 and bottom surfaces of the distal end portions 82A of the respective coupling parts 82. Each of the cutting portions 90 includes the concave groove 83 in the bottom surface 90A at a border between the end portion 22A and the distal end portion 82A for an entire length of the distal end portion 82A. Namely, each cutting portion 90 includes the end portion 22A of the projecting bottom plate 22, the distal end portion 82A of the coupling part 82, the bottom surface 90A, and the groove 83. The cutting portion 90 is separated into the end portion 22A and the distal end portion 82A when cut at the groove 83.

Therefore, at the position where the projecting bottom plate 22 and the coupling part 82 of the carrier 81 are separated, the concave groove 83 that is recessed with the notch shape is formed along the entire width of the bottom surface 80D at the border between the projecting bottom plate 22 and the coupling part 82 of the carrier 81. When the projecting bottom plate 22 and the coupling part 82 of the carrier 81 are separated by cutting at the position of the concave groove 83, the carrier cut part 28 is provided at the upper edge part along the plate thickness of the projecting bottom plate 22 and the projection 29 formed by the cutting is disposed on the upper surface 22U side as compared to the bottom surface 22D.

That is to say, after the projecting bottom plate 22 of the connection tubular part 20 and the coupling part 82 of the carrier 81 are separated by cutting, the carrier cut part 28 has the projection 29 formed due to the cutting but the projection 29 will not protrude downward below the bottom surface 22D of the projecting bottom plate 22. Thus, when the female terminal 10 is inserted into the cavity 41 of the housing 40, the shaving of the lower inner surface 41D of the cavity 41 by the projection 29 can be suppressed. In addition, since the shaving of the lower inner surface 41D of the cavity 41 by the projection 29 can be suppressed, the increase of the resistance in inserting the female terminal 10 can be suppressed.

According to the present embodiment, the connection tubular part 20 includes the bottom plate 21, the ceiling plate 23 that faces the bottom plate 21 in the up-down direction, and the pair of side plates 24 coupling between both side edges of the bottom plate 21 and both side edges of the ceiling plate 23, and thus, the connection tubular part 20 has the tubular shape into which the counterpart terminal can be inserted. In addition, one of the pair of side plates 24 includes the elastic piece 26 that is in elastic contact with the counterpart terminal. Furthermore, the concave part 27 with a recessed shape is provided to the end part on the bottom plate 21 side at the front edge of the side plate 24 where the counterpart terminal is inserted, and the carrier cut part 28 is provided at the front edge of the projecting bottom plate 22 that projects in the concave part 27 at the bottom plate 21.

That is to say, the carrier cut part 28 is provided to the projecting bottom plate 22 that projects in the concave part 27 provided to the side plate 24; therefore, for example, as compared to the case in which the concave part is not provided to the side plate, the stress is applied less on the side plates 24 when the projecting bottom plate 22 and the coupling part 82 of the carrier 81 are separated by cutting.

Thus, the stress is applied less on the side plate 24 including the elastic piece 26 to be in elastic contact with the counterpart terminal, and the decrease in connection reliability between the counterpart terminal and the connection tubular part 20 can be suppressed.

In addition, in the chain terminal 80 according to the present embodiment, the concave groove 83 provided between the projecting bottom plate 22 and the coupling part 82 of the carrier 81 is smaller in the front-back direction (the direction where the female terminal 10 and the carrier 81 are coupled) than the plate thickness of the projecting bottom plate 22 and formed along the entire width of the border between the projecting bottom plate 22 and the coupling part 82 of the carrier 81.

That is to say, with the accuracy of the cutting position between the projecting bottom plate 22 and the coupling part 82 of the carrier 81 increased, the border between the projecting bottom plate 22 and the coupling part 82 of the carrier 81 is cut; therefore, the dimensional accuracy of the female terminal 10 that is separated from the chain terminal 80 can be improved.

Second Embodiment

Next, a second embodiment is described with reference to FIG. 21.

The second embodiment is different from the first embodiment in the shape of the concave groove 83 of the chain terminal 80, and the structure, operation, and effect that are common to the first embodiment are not described. The same structure as that in the first embodiment is denoted by the same reference symbol.

Figure 21:
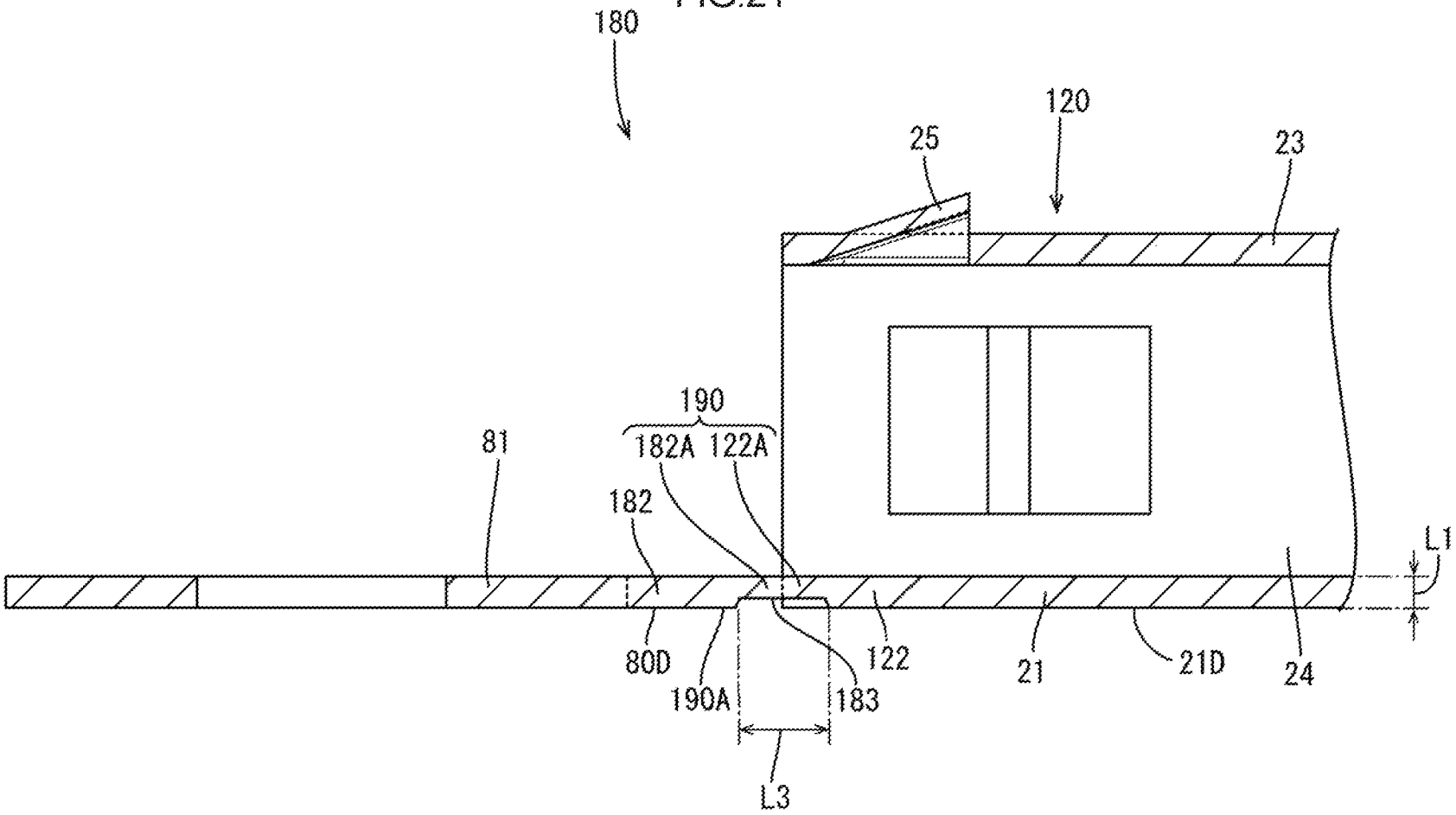
FIG. 21 is a magnified cross-sectional view of a part corresponding to a cross section of a chain terminal according to a second embodiment illustrated in FIG. 17.
Figure 22:
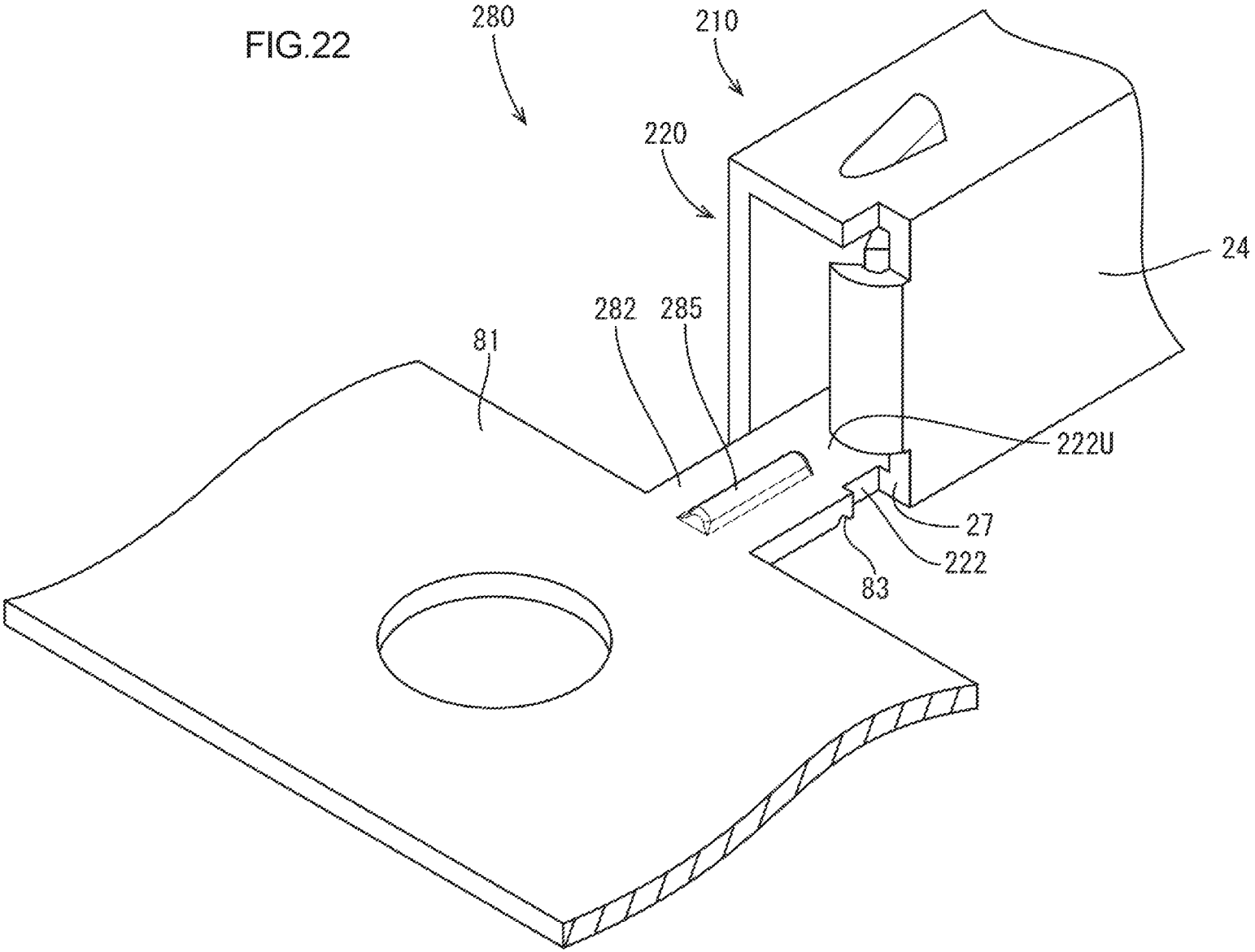
FIG. 22 is a magnified perspective view of a part of a chain terminal according to a third embodiment.
Figure 23:
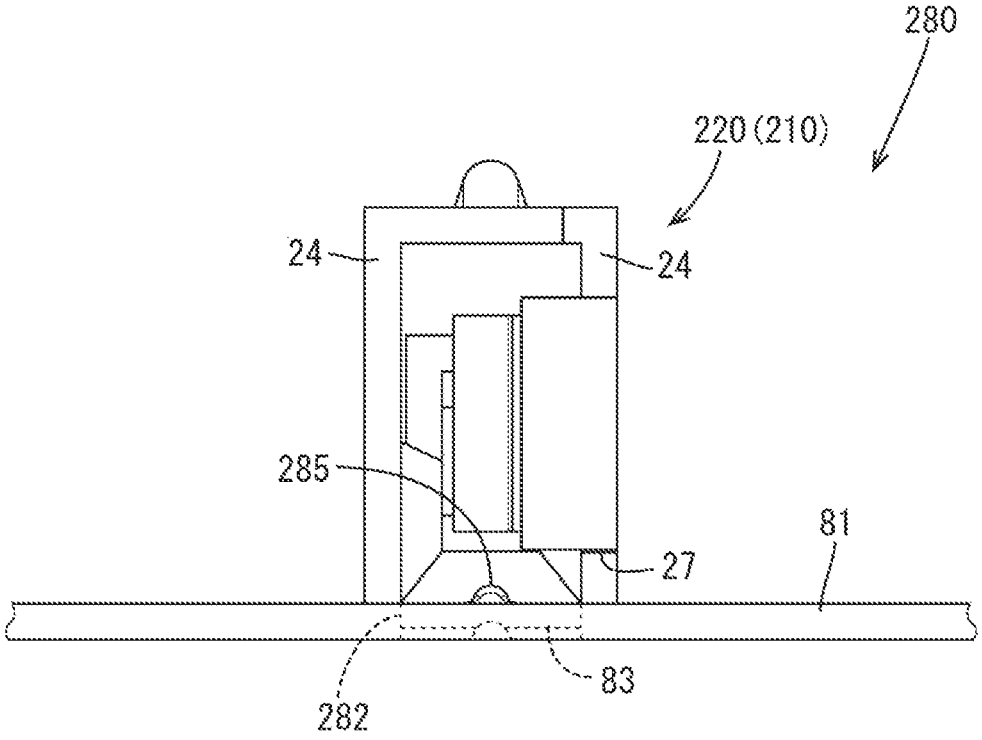
FIG. 23 is a magnified front view of a part of the chain terminal.
Figure 24:
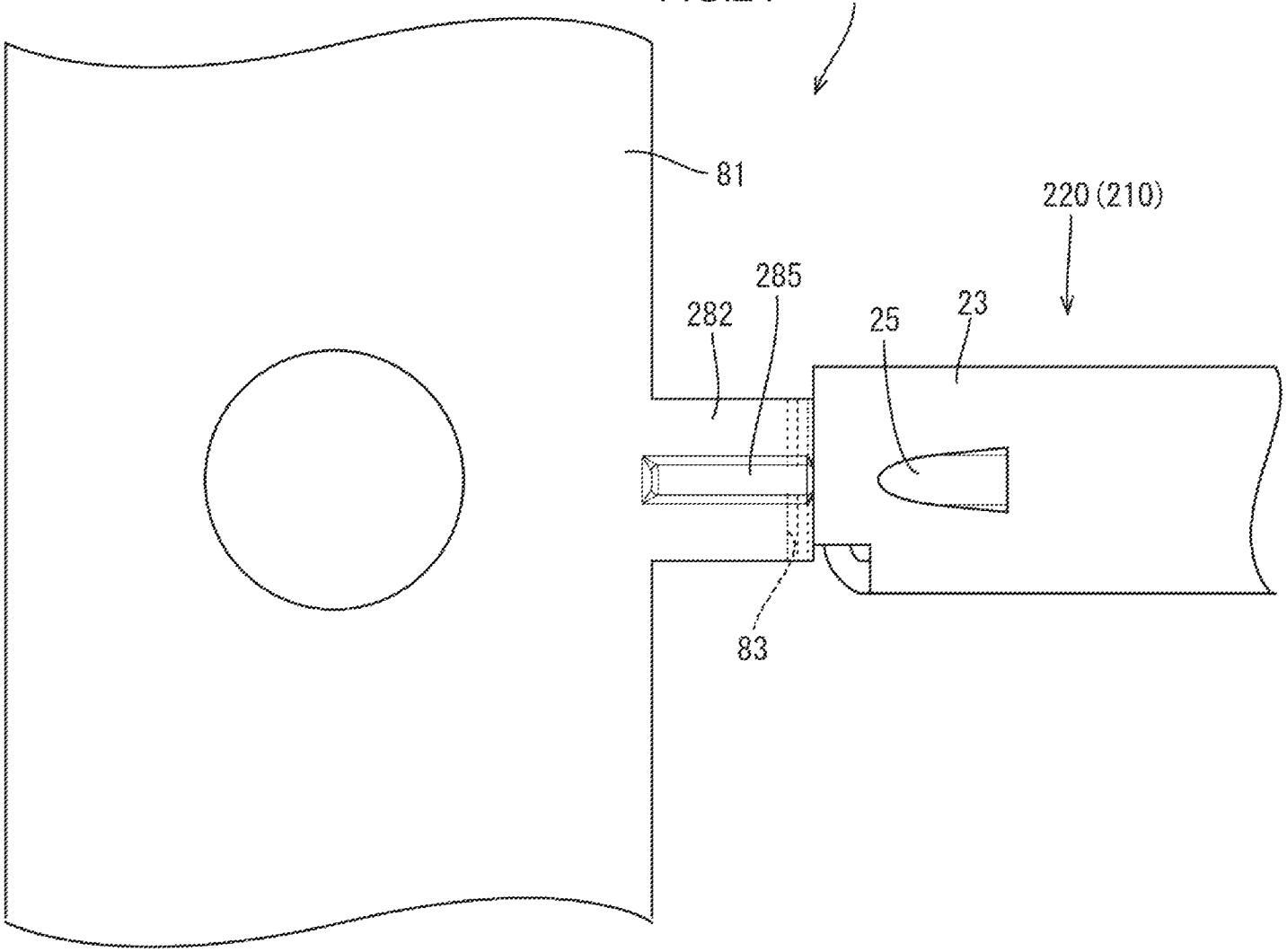
FIG. 24 is a magnified plan view of the part of the chain terminal.
Figure 25:
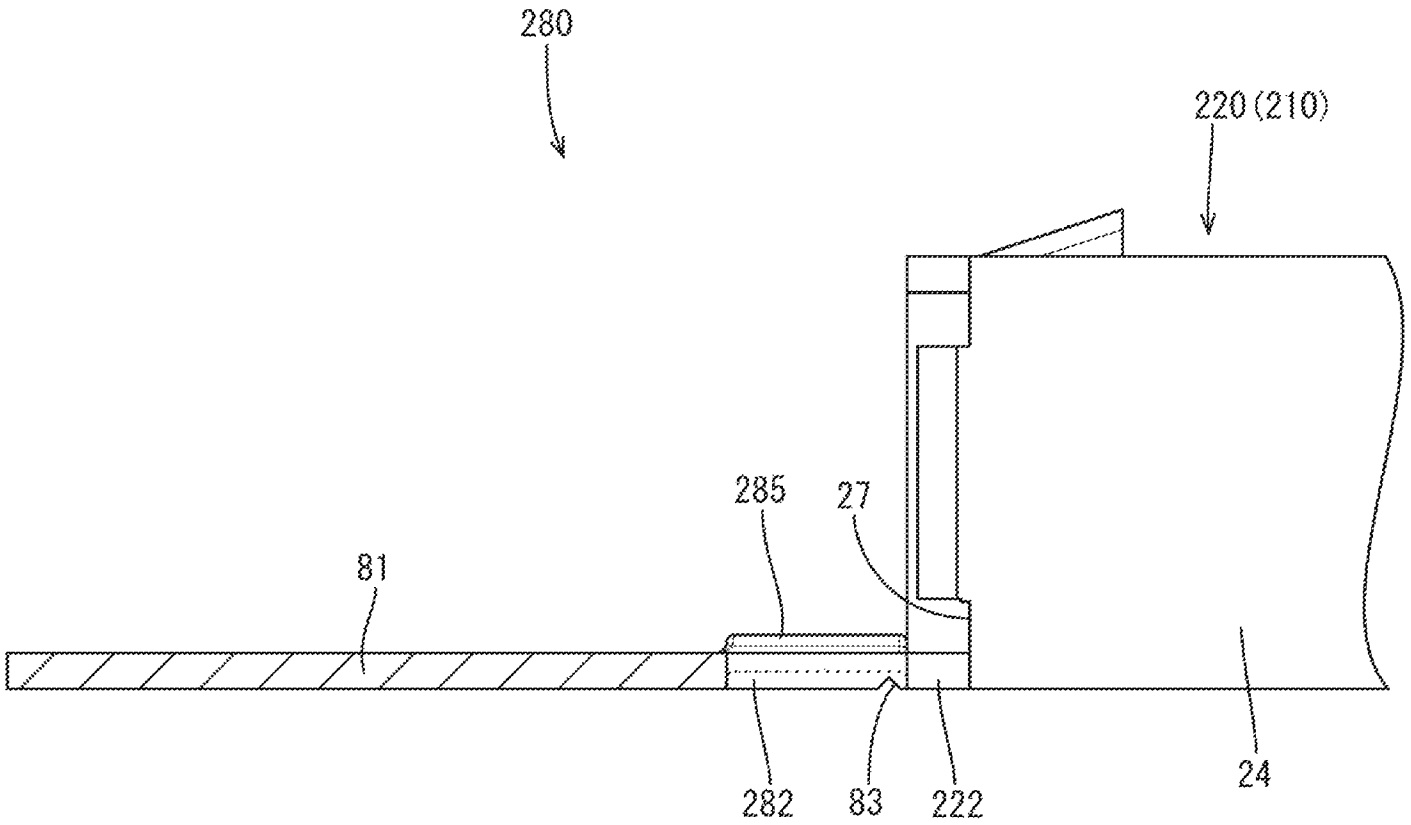
FIG. 25 is a magnified side view of the part of the chain terminal.

A concave groove 183 of a chain terminal 180 according to the second embodiment has a length L3 in the front-back direction (direction of coupling a female terminal 10 and a carrier 81) that is larger than a plate thickness L1 of a projecting bottom plate 122 of a connection tubular part 120 as illustrated in FIG. 21.

Therefore, as the concave groove 183 becomes larger in the front-back direction, the accuracy of the cutting position by the cutting blade C can be relieved. Thus, the cutting position can be adjusted more easily and the productivity can be improved.

Third Embodiment

Next, a third embodiment is described with reference to FIG. 22 to FIG. 26.

The third embodiment is different from the first embodiment in the shape of the part where the projecting bottom plate 22 and the coupling part 82 of the carrier 81 of the chain terminal 80 are coupled, and the structure, operation, and effect that are common to the first embodiment are not described. The same structure as that in the first embodiment is denoted by the same reference symbol.

A chain terminal 280 according to the third embodiment includes a reinforcement part 285 that reinforces between a coupling part 282 of a carrier 81 and a projecting bottom plate 222 of a female terminal 210.

The reinforcement part 285 is formed to be extended between the coupling part 282 of the carrier 81 and the projecting bottom plate 222 of a connection tubular part 220 at an approximately central part in the right-left direction of the projecting bottom plate 222 and the coupling part 282, and has a shape of projecting like a rib upward from an upper surface 282U of the coupling part 282 and an upper surface 222U of the projecting bottom plate 222.

Therefore, the reinforcement part 285 can increase the strength of the part ranging from the coupling part 282 of the carrier 81 to the projecting bottom plate 222.

Figure 26:
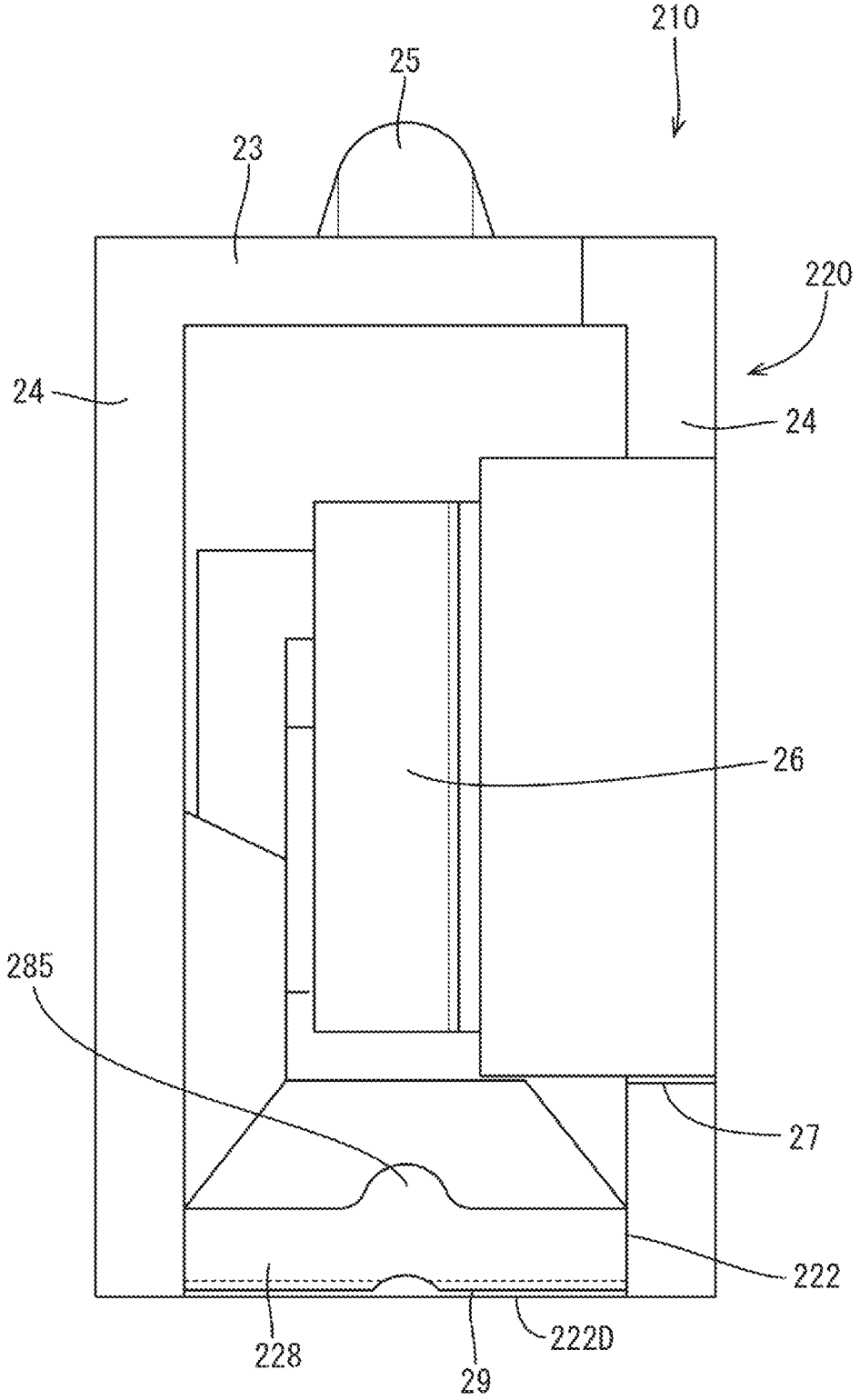
FIG. 26 is a front view of a female terminal according to the third embodiment.
Figure 27:
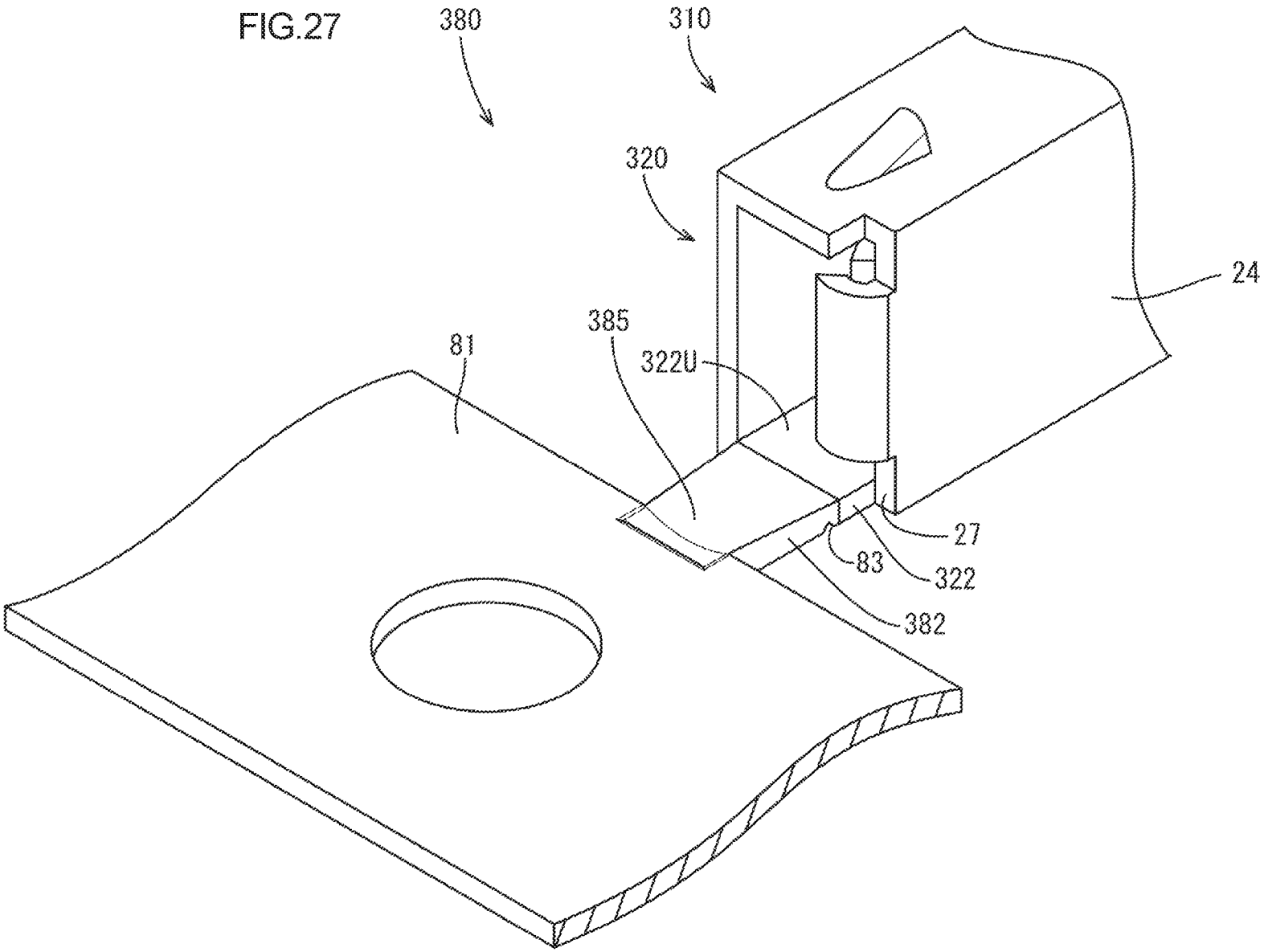
FIG. 27 is a magnified perspective view of a part of a chain terminal according to a modification.
Figure 28:
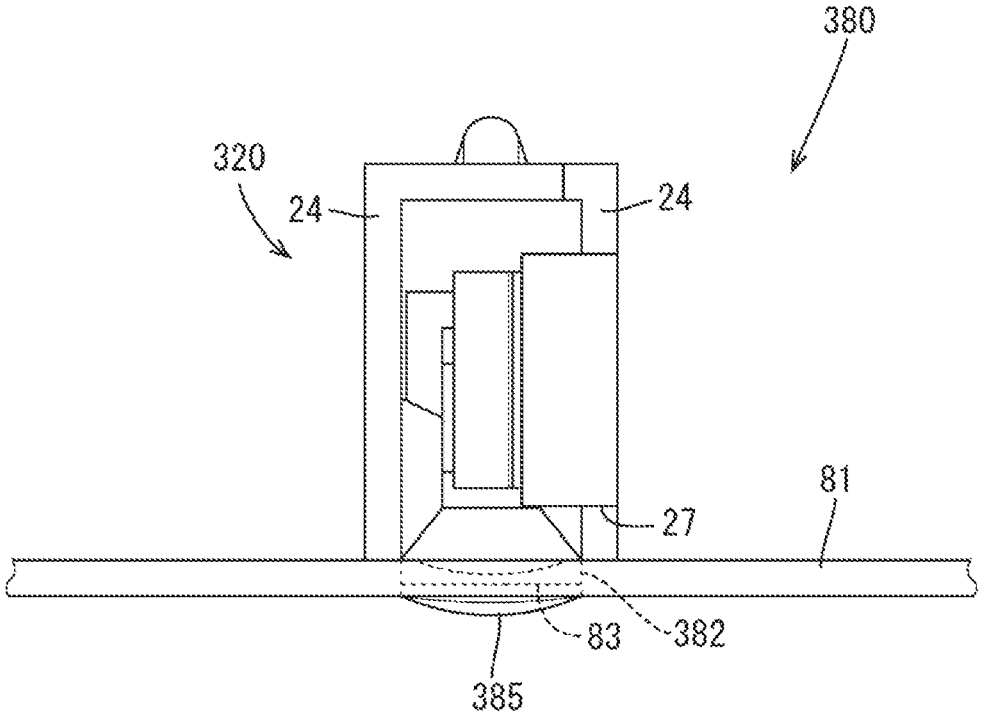
FIG. 28 is a magnified front view of a part of the chain terminal.
Figure 29:
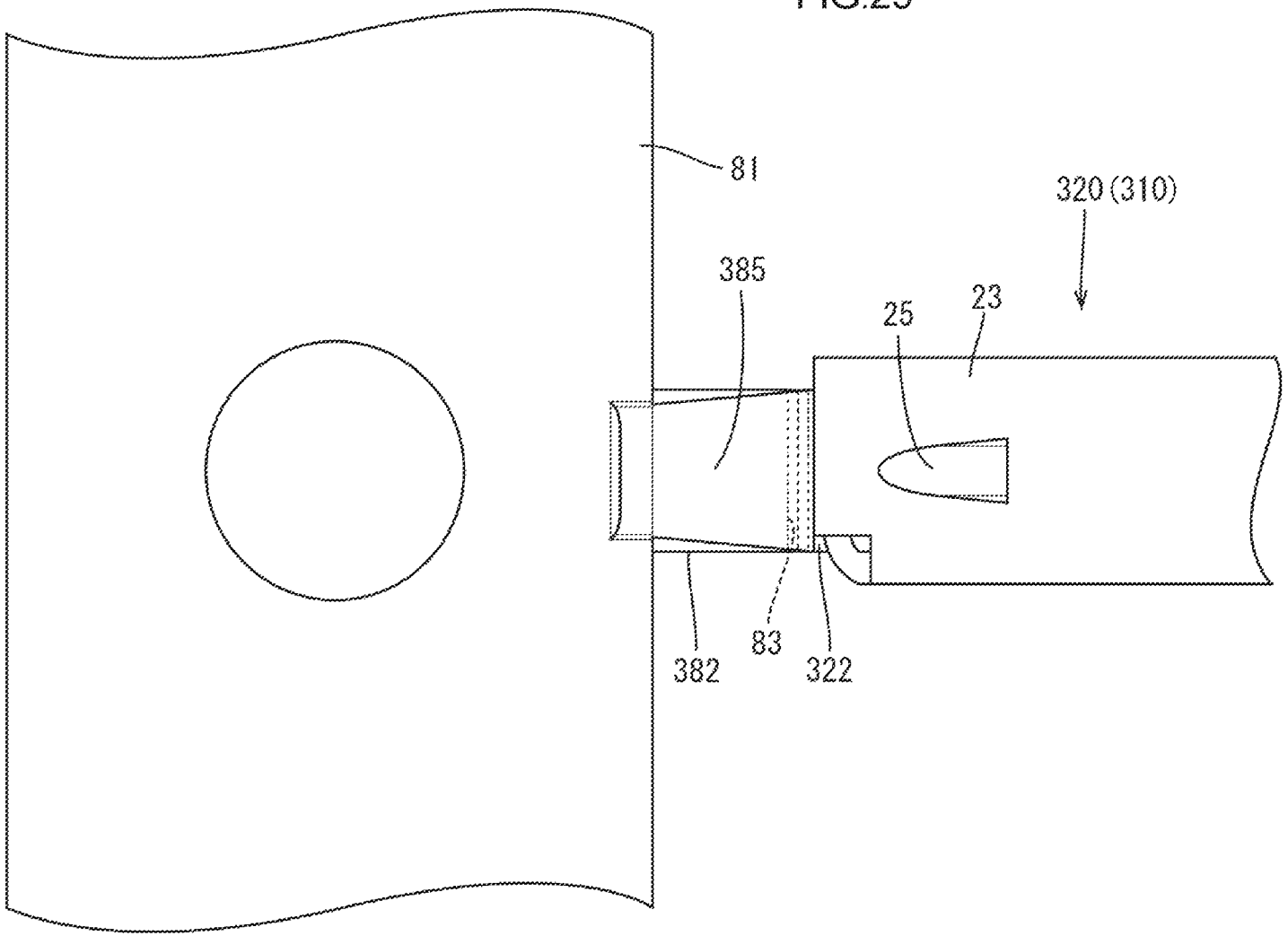
FIG. 29 is a magnified plan view of the part of the chain terminal.
Figure 30:
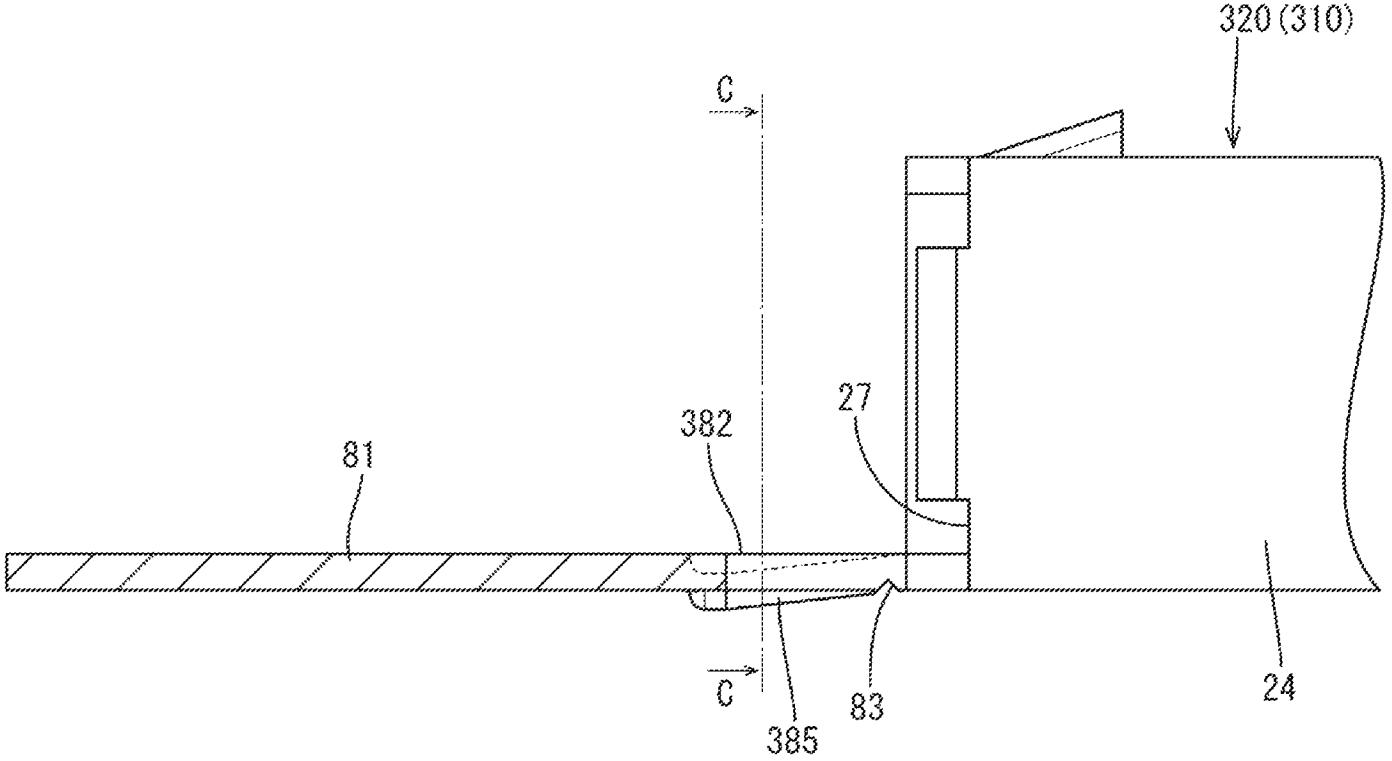
FIG. 30 is a magnified side view of the part of the chain terminal.

Then, when the position of a concave groove 83 corresponding to the border between the coupling part 282 and the projecting bottom plate 222 is cut with the cutting blade C, the reinforcement part 285 that is cut by the cutting blade C together with a carrier cut part 28 is formed at the front end part of the projecting bottom plate 222 of the female terminal 210 as illustrated in FIG. 26.

That is to say, when the concave groove 83 is formed at the border between the projecting bottom plate 22 and the coupling part 282 of the carrier 81 in the chain terminal 280, the strength between the coupling part 282 and the projecting bottom plate 222 may decrease.

However, in the present embodiment, the reinforcement part 285 enhances the strength between the projecting bottom plate 222 and the coupling part 282 of the carrier 81; therefore, in the case of conveying the chain terminal 280, for example, the falling of the female terminal 210 from the chain terminal 280 due the contact with another member can be suppressed.

<Modifications>

Next, a first modification of the third embodiment is described with reference to FIG. 27 to FIG. 32.

The present modification is different from the third embodiment in the shape of the reinforcement part 285, and similarly to the third embodiment, the reinforcement part 285 reinforces between a coupling part 382 of the carrier 81 and a projecting bottom plate 322 of a connection tubular part 320 of a female terminal 310. Note that the structure, operation, and effect that are common to the first embodiment are not described. The same structure as that in the first embodiment is denoted by the same reference symbol.

Figure 31:
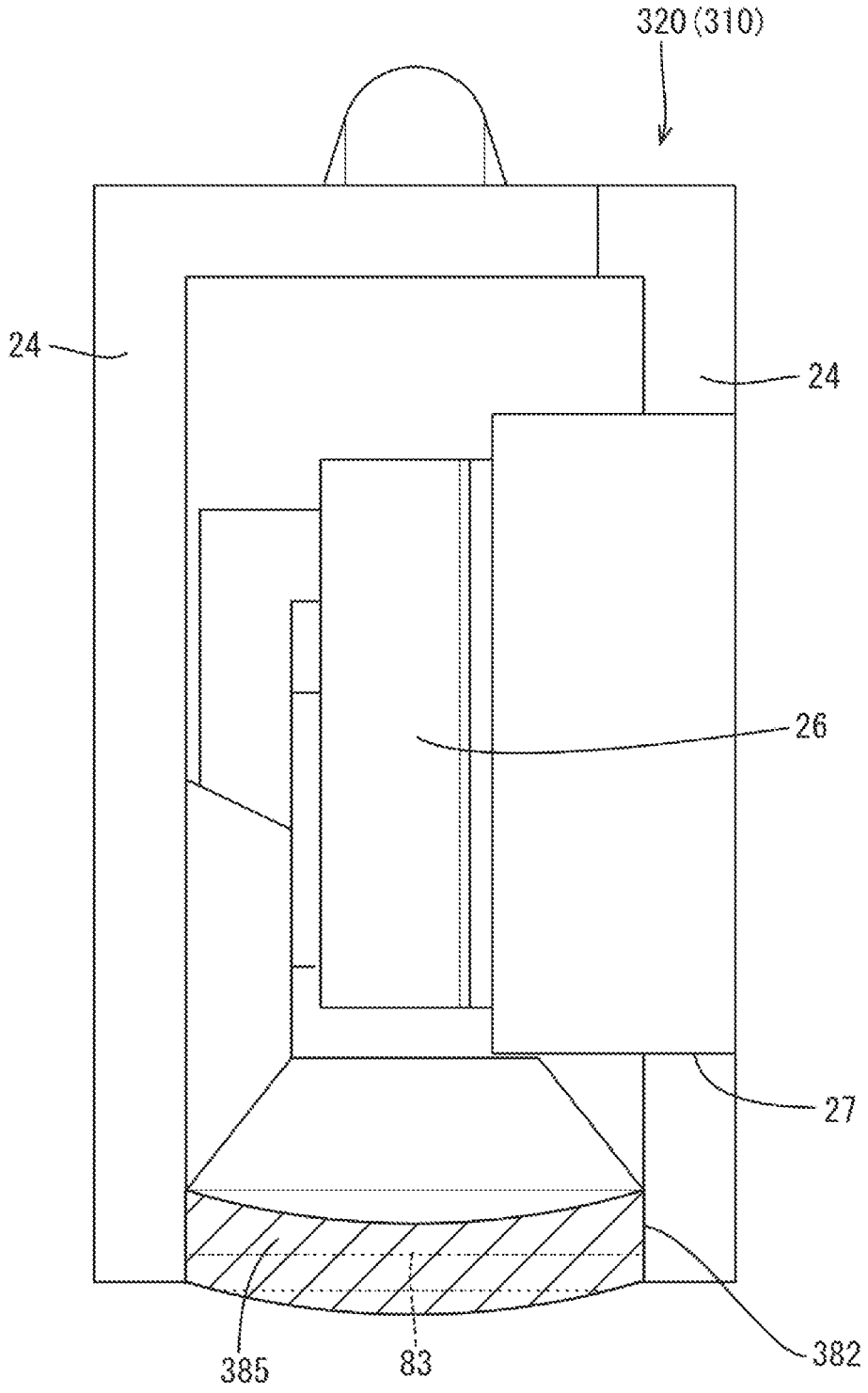
FIG. 31 is a cross-sectional view taken along line C-C in FIG. 30.

In the modification, the part between the coupling part 382 of the carrier 81 and the position a little on the rear from the front end of the projecting bottom plate 322 is formed to have an arc-like cross-sectional shape so as to form a reinforcement part 385 as illustrated in FIG. 31. More specifically, the reinforcement part 385 is warped like an arc shape with a central part in the right-left direction recessed downward in a direction from the front end of the projecting bottom plate 322 to the coupling part 382 as illustrated in FIG. 27 to FIG. 31.

Therefore, similarly to the third embodiment, the strength of the front end part of the projecting bottom plate 322 from the coupling part 382 of the carrier 81 can be increased by the reinforcement part 385.

Figure 32:
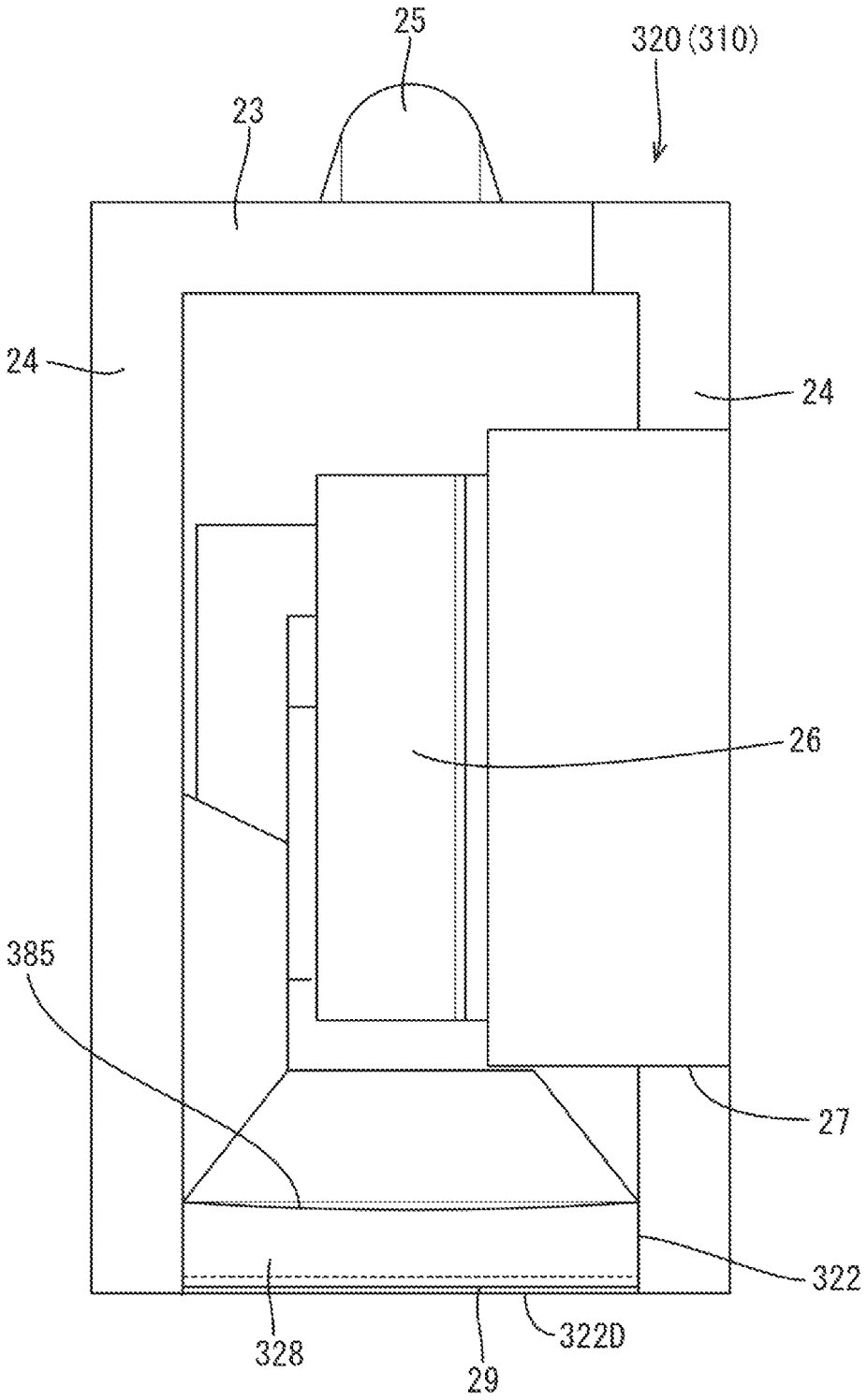
FIG. 32 is a front view of a female terminal according to the modification.

In addition, when the position of the concave groove 83 corresponding to the border between the coupling part 382 and the projecting bottom plate 322 is cut with the cutting blade C, a carrier cut part 328 with an arc-like shape is formed at the front end part of the projecting bottom plate 322 of the female terminal 310 as illustrated in FIG. 32.

That is to say, when the concave groove 83 is formed at the border between the projecting bottom plate 322 and the coupling part 382 of the carrier 81 in a chain terminal 380, the strength between the coupling part 382 and the projecting bottom plate 222 may decrease. However, the reinforcement part 385 enhances the strength between the front end part of the projecting bottom plate 322 and the coupling part 382 of the carrier 81; therefore, the falling of the female terminal 210 from the chain terminal 280 can be suppressed.

Other Embodiments

The technology disclosed herein is not limited to the embodiments described above with reference to the drawings and other embodiments to be described below are also included, for example.

(1) In the above embodiments, the carrier cut parts 28 and 328, and the projection 29 are provided to the projecting bottom plates 22, 122, 222, and 322 of the female terminals 10, 210, and 310. However, the present invention is not limited thereto and the carrier cut part and the projection may be provided to a bottom plate of a male terminal.

(2) In the above embodiments, the connection tubular parts 20, 120, 220, and 320 have the rectangular tubular shape that is approximately rectangular in the front view. However, the present invention is not limited thereto and it is only necessary that the connection tubular part have the bottom plate. The connection tubular part may have a rectangular tubular shape that is triangular or polygonal with five or more sides, or cylindrical.

(4) In the above embodiments, the elastic piece 26 is provided to the side plate 24. However, the present invention is not limited thereto and the elastic piece may be provided to the bottom plate or the ceiling plate.

(5) In the above third embodiment, the reinforcement part 285 with the rib shape is formed to be extended between the coupling part 282 of the carrier 81 and the projecting bottom plate 222 at a central part in the right-left direction, and in the above modification, the reinforcement part 385 is formed with the front end part of the projecting bottom plate 322 and the coupling part 382 of the carrier 81 warped downward. However, the present invention is not limited thereto and a plurality of rib-shaped reinforcement parts may be extended between the coupling part of the carrier and the projecting bottom plate, or the reinforcement part may be formed with the front end part of the projecting bottom plate and the coupling part warped upward.

EXPLANATION OF SYMBOLS

10, 210, 310: Female terminal (One example of "terminal")
20, 120, 220, 320: Connection tubular part (One example of "terminal connection part")
21: Bottom plate
21D: Bottom surface of bottom plate
21U: Upper surface (One example of "surface opposite to bottom surface")
22, 122, 222, 322 Projecting bottom plate (One example of "bottom plate projecting in concave part")
22D: Bottom surface of projecting bottom plate
22U: Upper surface of projecting bottom plate (One example of "surface opposite to bottom surface")
23: Ceiling plate
24: Side plate
26: Elastic piece
27: Concave part
28, 328: Carrier cut part
29: Projection
40: Housing
60: Connector
80, 280, 380: Chain terminal
81: Carrier
82, 282, 382: Coupling part (One example of "carrier")
83, 183: Concave groove
285, 385: Reinforcement part

What is claimed is:

1. A terminal arranged in a housing, comprising:
a terminal connection part that is to be connected to a counterpart terminal and includes a bottom plate, the bottom plate having a bottom surface opposite the housing and an upper surface that is an opposite surface from the bottom surface;
a concave groove having an inclined surface extending upward from a front edge of the bottom surface;
a carrier cut part extending downward from a front edge of the upper surface; and
a projection having a basal end and a tip end, the basal end being continuous with the lower end of the carrier cut part and with the front end of the concave groove, the tip end being located above a level of the bottom surface.

2. The terminal according to claim 1, wherein
the terminal connection part includes the bottom plate, a ceiling plate that faces the bottom plate, and a pair of side plates coupling between both side edges of the bottom plate and both side edges of the ceiling plate, the terminal connection part having a tubular shape into which the counterpart terminal can be inserted,
the side plate includes a concave part with a recessed shape at an end part on a side of the bottom plate at an edge of the side plate on a side where the counterpart terminal is inserted, and
the carrier cut part is provided at the edge of the bottom plate that projects in the concave part at the bottom plate.

3. The terminal according to claim 2, wherein the side plate includes an elastic piece that is in elastic contact with the counterpart terminal.

4. The terminal according to claim 1, further comprising a reinforcement part that reinforces the bottom plate in a part of the bottom plate where the carrier cut part is provided.

5. A chain terminal comprising:
a plurality of terminals each including terminal connection parts with bottom plates;
a carrier having a belt shape, the carrier including coupling parts extending from a long edge of the carrier adjacent to the plurality of terminals to the bottom plates, respectively;

cutting portions each including end portions of the bottom plates and distal end portions of the respective coupling parts with bottom surfaces each including bottom surfaces of the end portions of the bottom plates and bottom surfaces of the distal end portions of the respective coupling parts, each of the cutting portions including a concave groove in one of the bottom surfaces at a border between one of the end portions and one of the distal end portions, the concave groove extending for an entire length of the one of the distal end portions; and a reinforcement part in the bottom plate and the carrier, the reinforcement part reinforcing a part where the concave groove is provided, the reinforcing part extending in a direction in which the terminal and the carrier are to be coupled together, the reinforcement part projecting in a thickness direction of the bottom plate.

6. The chain terminal according to claim 5, wherein the concave groove is larger in a direction where the terminal and the carrier are coupled than a plate thickness of the bottom plate and is formed along an entire width of the border between the bottom plate and the carrier.

7. The chain terminal according to claim 5, wherein the concave groove is smaller in a direction where the terminal and the carrier are coupled than a plate thickness of the bottom plate and is formed along an entire width of the border between the bottom plate and the carrier.

8. A connector comprising:

the terminal according to claim 1; and a housing that contains the terminal.

* * * * *